US010293604B2

(12) United States Patent
Aoki et al.

(10) Patent No.: US 10,293,604 B2
(45) Date of Patent: May 21, 2019

(54) LIQUID EJECTION HEAD, LIQUID EJECTION APPARATUS, AND TEMPERATURE CONTROL METHOD FOR LIQUID EJECTION HEAD

(71) Applicant: CANON KABUSHIKI KAISHA, Tokyo (JP)

(72) Inventors: Takatsuna Aoki, Yokohama (JP); Shuzo Iwanaga, Kawasaki (JP); Seiichiro Karita, Saitama (JP); Kazuhiro Yamada, Yokohama (JP); Shingo Okushima, Kawasaki (JP); Zentaro Tamenaga, Sagamihara (JP); Akira Yamamoto, Yokohama (JP); Tatsurou Mori, Yokohama (JP); Noriyasu Nagai, Tokyo (JP); Akio Saito, Machida (JP); Masashi Hayashi, Yokohama (JP); Takeshi Murase, Yokohama (JP); Yuki Sawai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 15/459,408

(22) Filed: Mar. 15, 2017

(65) Prior Publication Data

US 2017/0274647 A1 Sep. 28, 2017

(30) Foreign Application Priority Data

Mar. 25, 2016 (JP) ..... 2016-061802

(51) Int. Cl.
*B41J 2/045* (2006.01)
*B41J 2/14* (2006.01)

(52) U.S. Cl.
CPC ..... *B41J 2/04563* (2013.01); *B41J 2/0458* (2013.01); *B41J 2/14032* (2013.01)

(58) Field of Classification Search
CPC .. B41J 2/0458; B41J 2/04581; B41J 2/04566; B41J 2/04586; B41J 2/04563; B41J 2/14032; B41J 2/14056; B41J 2002/14483
See application file for complete search history.

(56) References Cited

U.S. PATENT DOCUMENTS 5,006,867 A 4/1991 Koizumi et al.
5,175,565 A 12/1992 Ishinaga et al.
5,424,767 A * 6/1995 Alavizadeh ..... B41J 2/17593 347/17
5,467,113 A * 11/1995 Ishinaga ..... B41J 2/04528 347/17
5,485,182 A 1/1996 Takayanagi et al.
5,760,797 A 6/1998 Koizumi et al.
(Continued)

FOREIGN PATENT DOCUMENTS

JP 08-58077 A 3/1996

OTHER PUBLICATIONS

U.S. Appl. No. 15/409,973, Yumi Komamiya, Takatsuna Aoki, Shingo Okushima, Takuto Moriguchi, filed Jan. 19, 2017.

*Primary Examiner* — Thinh H Nguyen
(74) *Attorney, Agent, or Firm* — Venable LLP

(57) ABSTRACT

In order to keep possible local temperature differences in a liquid ejection head small to allow stable liquid ejection performance to be achieved, temperatures in a plurality of heating areas in a liquid ejection head are discretely controlled using heating elements and temperature detection elements.

16 Claims, 27 Drawing Sheets

(56) References Cited

U.S. PATENT DOCUMENTS

| | | | | |
|---|---|---|---|---|
| 5,867,200 | A | 2/1999 | Tajima et al. | |
| 5,880,753 | A | 3/1999 | Ikeda et al. | |
| 6,471,321 | B1 | 10/2002 | Aono et al. | |
| 7,722,148 | B2 | 5/2010 | Takabayashi et al. | |
| 2003/0052932 | A1 | 3/2003 | Karita et al. | |
| 2004/0036729 | A1* | 2/2004 | Westdijk | B41J 2/04528 347/17 |

* cited by examiner

| TABLE ID | HEATING VALUE OF HEATING ELEMENT |
|---|---|
| 32 | 20.0W |
| 31 | 19.4W |
| 30 | 18.8W |
| 29 | 18.1W |
| 28 | 17.5W |
| 27 | 16.9W |
| 26 | 16.3W |
| 25 | 15.6W |
| 24 | 15.0W |
| 23 | 14.4W |
| 22 | 13.8W |
| 21 | 13.1W |
| 20 | 12.5W |
| 19 | 11.9W |
| 18 | 11.3W |
| 17 | 10.6W |
| 16 | 10.0W |
| 15 | 9.4W |
| 14 | 8.8W |
| 13 | 8.1W |
| 12 | 7.5W |
| 11 | 6.9W |
| 10 | 6.3W |
| 9 | 5.6W |
| 8 | 5.0W |
| 7 | 4.4W |
| 6 | 3.8W |
| 5 | 3.1W |
| 4 | 2.5W |
| 3 | 1.9W |
| 2 | 1.3W |
| 1 | 0.6W |

FIG.3

| HEATING ELEMENT ID | TEMPERATURE CONTROL SETTING REGISTER |
|---|---|
| 5a-5j | 0x0000-0x0007 |

| DIFFERENCE FROM TARGET TEMPERATURE (T) | HEATING VALUE TABLE REFERENCE TARGET ID |
|---|---|
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |

FIG.4

| HEATING ELEMENT ID | IDENTIFIER | CORRECTION AMOUNT FOR HEATING VALUE BASED ON HEAT TRANSFER CHARACTERISTICS |
|---|---|---|
| 5a | 1 | 1 |
| 5b | 2 | 0 |
| 5c | 3 | -1 |
| 5d | 2 | 0 |
| | | |
| 5i | 2 | 0 |
| 5j | 1 | 1 |

FIG.10

(a)

| HEATING ELEMENT ID | TEMPERATURE CONTROL SETTING REGISTER |
|---|---|
| 5a | 0x0000-0x0007 |
| 5b | 0x0008-0x000F |
| 5c | 0x0010-0x0017 |
| | |
| | |
| 5h | 0x0038-0x001F |
| 5i | 0x0040-0x0047 |

(b)

| DIFFERENCE FROM TARGET TEMPERATURE (T) | HEATING VALUE TABLE REFERENCE TARGET ID |
|---|---|
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |

+

(c)

| CORRECTION AMOUNT FOR HEATING VALUE BASED ON HEAT TRANSFER CHARACTERISTICS |
|---|
| 1 |
| 1 |
| 1 |
| 1 |
| 1 |
| 1 |
| 1 |
| 1 |
| 0 |
| 0 |
| 0 |
| 0 |
| 0 |
| 0 |
| 0 |
| 0 |
| -1 |
| -1 |
| -1 |
| -1 |
| -1 |
| -1 |
| -1 |
| -1 |

(d)

| DIFFERENCE FROM TARGET TEMPERATURE (T) | HEATING VALUE TABLE REFERENCE TARGET ID |
|---|---|
| 20.0~ | 31 |
| 15.0~20.0 | 26 |
| 10.0~15.0 | 21 |
| 5.0~10.0 | 17 |
| 2.0~5.0 | 12 |
| 1.0~2.0 | 8 |
| 0.5~1.0 | 5 |
| 0.0~0.5 | 3 |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| 20.0~ | 29 |
| 15.0~20.0 | 24 |
| 10.0~15.0 | 19 |
| 5.0~10.0 | 15 |
| 2.0~5.0 | 10 |
| 1.0~2.0 | 6 |
| 0.5~1.0 | 3 |
| 0.0~0.5 | 1 |

FIG.11

| HEATING ELEMENT ID | IDENTIFIER | CORRECTION AMOUNT FOR HEATING VALUE BASED ON HEAT TRANSFER CHARACTERISTICS |
|---|---|---|
| 5a | 1 | 1 |
| 5b | 2 | 0 |
| 5c | 3 | 1 |
| 5d | 2 | 0 |
| | | |
| | | |
| 5i | 2 | 0 |
| 5j | 1 | 1 |

FIG.16

(a)

| HEATING ELEMENT ID | TEMPERATURE CONTROL SETTING REGISTER |
|---|---|
| 5a | 0x0000-0x0007 |
| 5b | 0x0008-0x000F |
| 5c | 0x0010-0x0017 |
| | |
| | |
| 5h | 0x0038-0x001F |
| 5i | 0x0040-0x0047 |
| 5j | 0x0048-0x004F |

(b)

| DIFFERENCE FROM TARGET TEMPERATURE (T) | HEATING VALUE TABLE REFERENCE TARGET ID |
|---|---|
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| | |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |

(c)

| CORRECTION AMOUNT FOR HEATING VALUE BASED ON HEAT TRANSFER CHARACTERISTICS |
|---|
| 1 |
| 1 |
| 1 |
| 1 |
| 1 |
| 1 |
| 1 |
| 1 |
| |
| 0 |
| 0 |
| 0 |
| + 0 |
| 0 |
| 0 |
| 0 |
| 0 |
| -1 |
| -1 |
| -1 |
| -1 |
| -1 |
| -1 |
| -1 |
| -1 |

(d)

| DIFFERENCE FROM TARGET TEMPERATURE (T) | HEATING VALUE TABLE REFERENCE TARGET ID |
|---|---|
| 20.0~ | 31 |
| 15.0~20.0 | 26 |
| 10.0~15.0 | 21 |
| 5.0~10.0 | 17 |
| 2.0~5.0 | 12 |
| 1.0~2.0 | 8 |
| 0.5~1.0 | 5 |
| 0.0~0.5 | 3 |
| | |
| 20.0~ | 30 |
| 15.0~20.0 | 25 |
| 10.0~15.0 | 20 |
| 5.0~10.0 | 16 |
| 2.0~5.0 | 11 |
| 1.0~2.0 | 7 |
| 0.5~1.0 | 4 |
| 0.0~0.5 | 2 |
| 20.0~ | 29 |
| 15.0~20.0 | 24 |
| 10.0~15.0 | 19 |
| 5.0~10.0 | 15 |
| 2.0~5.0 | 10 |
| 1.0~2.0 | 6 |
| 0.5~1.0 | 3 |
| 0.0~0.5 | 1 |

FIG.27

LIQUID EJECTION HEAD, LIQUID EJECTION APPARATUS, AND TEMPERATURE CONTROL METHOD FOR LIQUID EJECTION HEAD

BACKGROUND OF THE INVENTION

Field of the Invention

The present invention relates to a liquid ejection head and a liquid ejection apparatus that can eject a liquid such as ink, and a temperature control method for the liquid ejection head.

Description of the Related Art

Japanese Patent Laid-Open No. H08-58077 (1996) describes, as a liquid ejection head, an ink jet print head that can eject liquid ink. The print head includes two types of heaters having different heating values in order to suppress variation in the ejection volume and ejection speed of ink in the print head resulting from variation in ink temperature. In a case where heating of the print head is started, the print head is rapidly heated to a predetermined temperature by the heater with the larger heating value. A given time later, the print head is stably heated by the heater with the smaller heating value.

The configuration described in Japanese Patent Laid-Open No. H08-58077 (1996) allows the print head to reach the predetermined temperature in a short time, and in a case where the temperature of the print head reaches an equilibrium state, enables a reduction in variation in heating value resulting from variation among heater drivers and among logics. However, the configuration needs a select circuit, a driver circuit, and the like to allow a plurality of types of heaters to be mounted in the print head. This increases a chip size for the print head, leading to a substantial increase in costs.

SUMMARY OF THE INVENTION

The present invention provides a liquid ejection head that is allowed to reach a required temperature in a short time and that can stably maintain, in a case where the temperature is at equilibrium, liquid ejection performance with a temperature difference kept small.

In the first aspect of the present invention, there is provided a liquid ejection head that ejects a liquid through an ejection port, the liquid ejection head comprising: an ejection energy generation element configured to generate energy utilized to eject the liquid; a detection unit configured to detect a temperature of the liquid ejection head; and a heating unit configured to heat the liquid ejection head by a heating value varying according to a temperature difference between a temperature detected by the detection unit and a predetermined target temperature.

In the second aspect of the present invention, there is provided a liquid ejection apparatus comprising: a liquid ejection head configured to eject a liquid through an ejection port; and a moving unit configured to move the liquid ejection head relative to a medium to which the liquid ejected from the liquid ejection head is applied, wherein the liquid ejection head comprises: an ejection energy generation element configured to generate energy utilized to eject the liquid; a detection unit configured to detect a temperature of the liquid ejection head; and a heating unit configured to heat the liquid ejection head by a heating value varying according to a temperature difference between a temperature detected by the detection unit and a predetermined target temperature.

In the third aspect of the present invention, there is provided a temperature control method for a liquid ejection head enabled to eject a liquid through a plurality of ejection ports, the method comprising: a first detection step of detecting a temperature in a first area in which some of the plurality of ejection ports are disposed; a second detection step of detecting a temperature in a second area in which some of the plurality of ejection ports are disposed; and a heating step of heating the first area according to a temperature difference between a predetermined target temperature and the temperature detected in the first detection step and heating the second area according to a temperature difference between the predetermined target temperature and the temperature detected in the second detection step.

In the aspect of the present invention, the temperatures in the plurality of areas in the liquid ejection head are discretely controlled to keep local temperature differences in the liquid ejection head small to allow stable ink ejection performance to be achieved.

Further features of the present invention will become apparent from the following description of exemplary embodiments with reference to the attached drawings.

BRIEF DESCRIPTION OF THE DRAWINGS

FIG. 3 is a diagram illustrating a heating value table;

FIG. 4 is a diagram illustrating a reference table;

FIG. 10 is a diagram illustrating a correction table of a heating value;

FIG. 11 is a diagram illustrating a relation between the correction table of the heating and a reference table;

FIG. 16 is a diagram illustrating a correction table of a heating value in the fifth embodiment of the present invention;

FIG. 27 is a diagram illustrating a relation between a correction table of the heating value and a reference table in the seventh embodiment of the present invention.

DESCRIPTION OF THE EMBODIMENTS

Embodiments of the present invention will be described below with reference to the drawings. The following description relates to a liquid ejection head that ejects a liquid such as ink and a liquid ejection apparatus with the liquid ejection head mounted therein. The liquid ejection head and the liquid ejection apparatus are applicable to apparatuses such as a printer, a copier, a facsimile machine having a communication system, and a word processor with a printer unit, and industrial processing apparatuses combined with various processing apparatuses. For example, the liquid ejection head and the liquid ejection apparatus can be used for biochip production, electronic-circuit printing, and semiconductor substrate fabrication. The embodiments described below are appropriate specific examples of the present invention, and thus, various technically preferable limitations are imposed on the embodiments. However, the present embodiment is not limited to the embodiments herein and other specific methods unless the concepts of the present invention are deviated.

First Embodiment

The present embodiment is an example of a case where a liquid ejection head and a liquid ejection apparatus are applied to an ink jet print head and an ink jet printing apparatus.

Figure 1A:
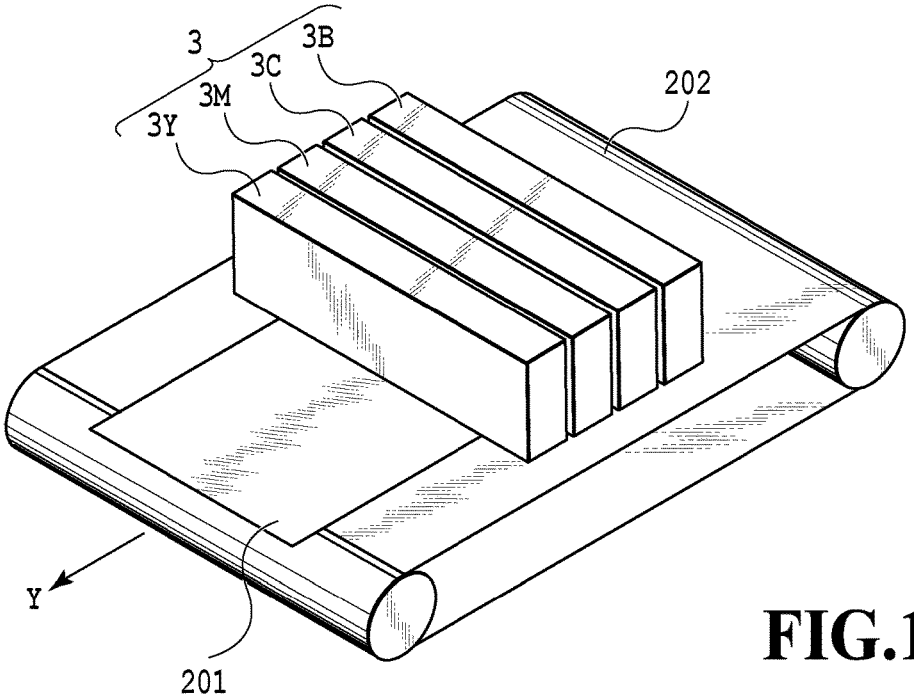
FIG. 1A is a schematic diagram of a configuration of an ink jet printing apparatus to which the present invention is applicable.
Figure 1B:
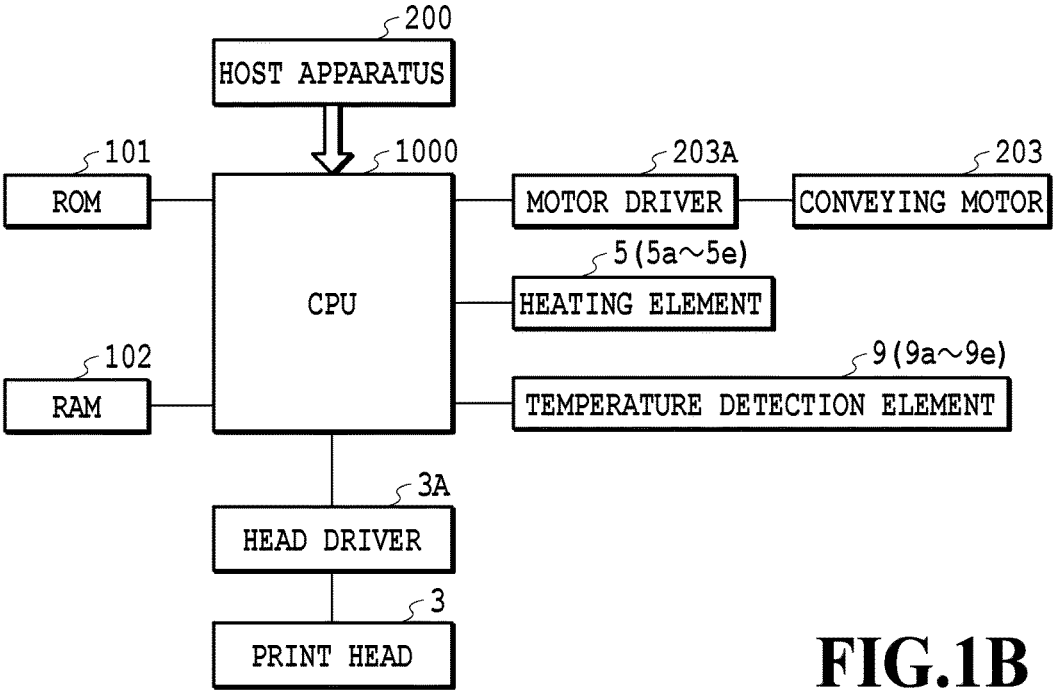
FIG. 1B is a block diagram of a control system for the printing apparatus.

FIG. 1A is a schematic perspective view of an ink jet printing apparatus to which the present invention is applicable. The printing apparatus in the present example is what is called a full-line printing apparatus including an ink jet print head (liquid ejection head) 3 extending in a width direction of a print medium 201. The print head 3 includes a print head 3Y that ejects yellow ink, a print head 3M that ejects magenta ink, a print head 3C that ejects cyan ink, and a print head 3B that ejects black ink. The print medium 201 is conveyed in a conveying direction illustrated by arrow Y, by a conveying unit 202 including a conveying belt or a conveying roller. FIG. 1B is a block diagram of a control system for the printing apparatus. A CPU 1000 executes control processing, data processing, and the like for the present printing apparatus. A ROM 101 stores programs for process procedures for the processing and the like. A RAM 102 is used as a work area where the processing is executed. Ink is ejected from the print head 3 by the CPU 1000 supplying a head driver 3A with driving data for ejection energy generation elements. The CPU 1000 controls, via a motor driver 203, a conveying motor 203 used to drive the conveying unit 202 for conveyance. The CPU 1000 controls heating elements (heating unit) described below based on temperatures detected by temperature detection elements (detection unit) described below. The present invention is applicable not only to such full-line printing apparatuses but also to what is called serial-scan printing apparatuses.

Figure 2:
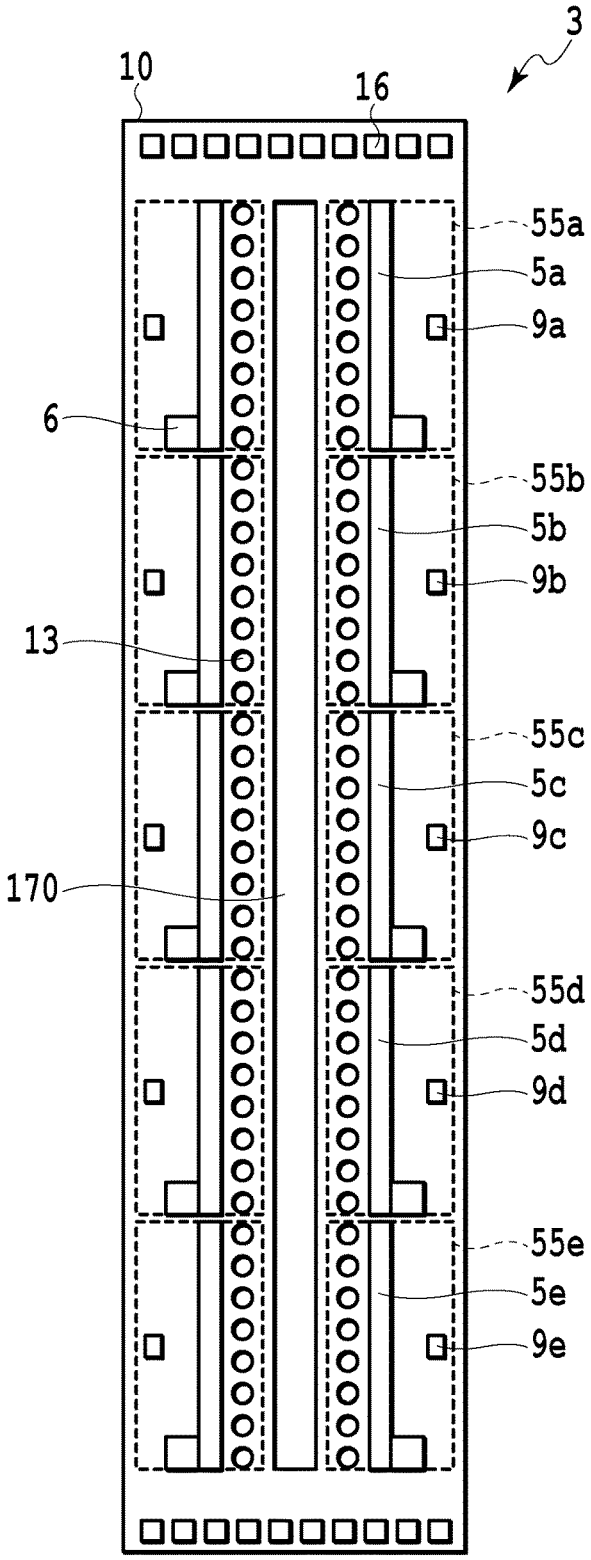
FIG. 2 is a diagram illustrating a printing element substrate in a first embodiment of the present invention.

FIG. 2 is a schematic diagram of a printing element substrate (substrate) 10 included in the print head 3. An ink supply port 170 is formed in a central portion of the printing element substrate 10. A plurality of ejection ports 13 is formed on opposite sides of the ink supply port 170 such that ink can be ejected through the ejection ports 13. The ejection ports 13 form an ejection port array extending in a direction intersecting a conveying direction for the print medium 201 (in the present example, a direction orthogonal to the conveying direction). Ink supplied through the ink supply port 170 is fed to pressure chambers corresponding to the respective ejection ports 13. In each of the pressure chambers, an ejection energy generation element is provided which is configured to eject the ink. Electrothermal transducing elements (heaters), piezoelectric elements, and the like can be used as the ejection energy generation elements. In a case where heaters are used, the ink in the pressure chambers is bubbled by heat generated by the heaters and can thus be ejected through the ejection ports 13 utilizing resultant bubbling energy. Pads 16 on the printing element substrate 10 are supplied with a power supply voltage and select data signals allowing selection of ejection ports through which the ink is to be ejected. The print head 3 can eject the ink at any timing through the ejection ports 13 selected based on print data.

An ejection speed and an ejection amount for the ink may be varied by the temperature of the ink in the pressure chamber. To achieve printing of high-quality images, the temperature of the ink in the pressure chambers is desirably limited to within a certain range. Thus, in the present embodiment, besides the ejection energy generation elements, heating elements 5 (5*a*, 5*b*, 5*c*, 5*d*, 5*e*) that can heat the printing element substrate 10 are arranged to heat the printing element substrate 10 and the ink and to keep temperature. Drivers (driving units) 6 are connected to the respective heating elements 5 to turn on and off driving currents for the heating elements 5. In the printing element substrate 10, one temperature detection element 9 (9*a*, 9*b*, 9*c*, 9*d*, 9*e*) is provided in one heating area 55 (55*a*, 55*b*, 55*c*, 55*d*, 55*e*). The temperature detection element 9 detects the temperature in the corresponding heating area 55. A plurality of the heating elements 5 and a plurality of the drivers 6 are disposed along an arrangement direction of the ejection ports 13. In a case where distances between the heating elements 5 and the corresponding pressure chambers are set approximately equal, the resolution and accuracy of temperature control can be increased.

In such a configuration, for each heating area 55, heat generation from the heating element 5 is controlled based on the temperature detected by the temperature detection element 9. Then, the temperature of the ink in the pressure chamber can be limited to within a certain range so as to prevent fluctuation of the ejection speed and ejection amount of the ink. However, in a case where, with focus placed on a temperature elevation rate of the ink in the pressure chamber, a heating value of the heating element 5 is increased, temperature amplitude is increased in a case where the ink in the pressure chamber is thermally at equilibrium. In contrast, in a case where the heating value of the heating element 5 is reduced, a longer time is needed for the ink in the pressure chamber to reach a target temperature, possibly preventing the target temperature from being reached.

Such a temperature amplitude of the ink in the pressure chamber results from the following factor. The heating element 5 is controlled based on a comparison result between the temperature detected by the temperature detection element 9 and the target temperature, and generates heat in a case where the detected temperature is low. At this time, in a case of a large heating value, the heating element 5 keeps generating heat until the next detection timing in a case where the temperature detection element 9 performs detection. Thus, the temperature near the heating element 5 may exceed the target temperature. This is particularly significant in a case where a significant difference is present between the temperature in an environment where the printing apparatus is installed and the target temperature for temperature control.

The temperature amplitude of the ink in the pressure chamber may vary ink ejection characteristics over time, which is not desirable in printing of high-quality images. On the other hand, for usability, a time from selection of a print job by the user until printing of the first image is completed is preferably short. Immediately printing and provision of high-quality images need a rapid increase in ink temperature in a case where the temperature of the ink in the pressure chamber is much lower than the target temperature and a reduction in the heating value of the heating element 5 in a case where the temperature of the ink in the pressure chamber is close to the target temperature.

Thus, in the present embodiment, the heating value of the heating element 5 corresponding to each temperature detection element 9 is set based on information on a differential value between the target temperature and the temperature detected by the temperature detection element 9.

FIG. 3 is a diagram illustrating a heating value table for the heating elements 5. FIG. 4 is a diagram illustrating a reference table that associates the heating value table for the heating element 5 with the differential value between the target temperature and the temperature detected by the temperature detection element 9. The RAM 102 or the like in the ink jet printing apparatus main body stores the heating value table used to allow the heating value of each heating element 5 to be varied in a step-by-step manner. For a register that controls the temperature of the heating element 5, a heating value table ID is set which reduces the heating value of the heating element 5 as the difference between the target temperature and the detected temperature becomes smaller.

Figure 5:
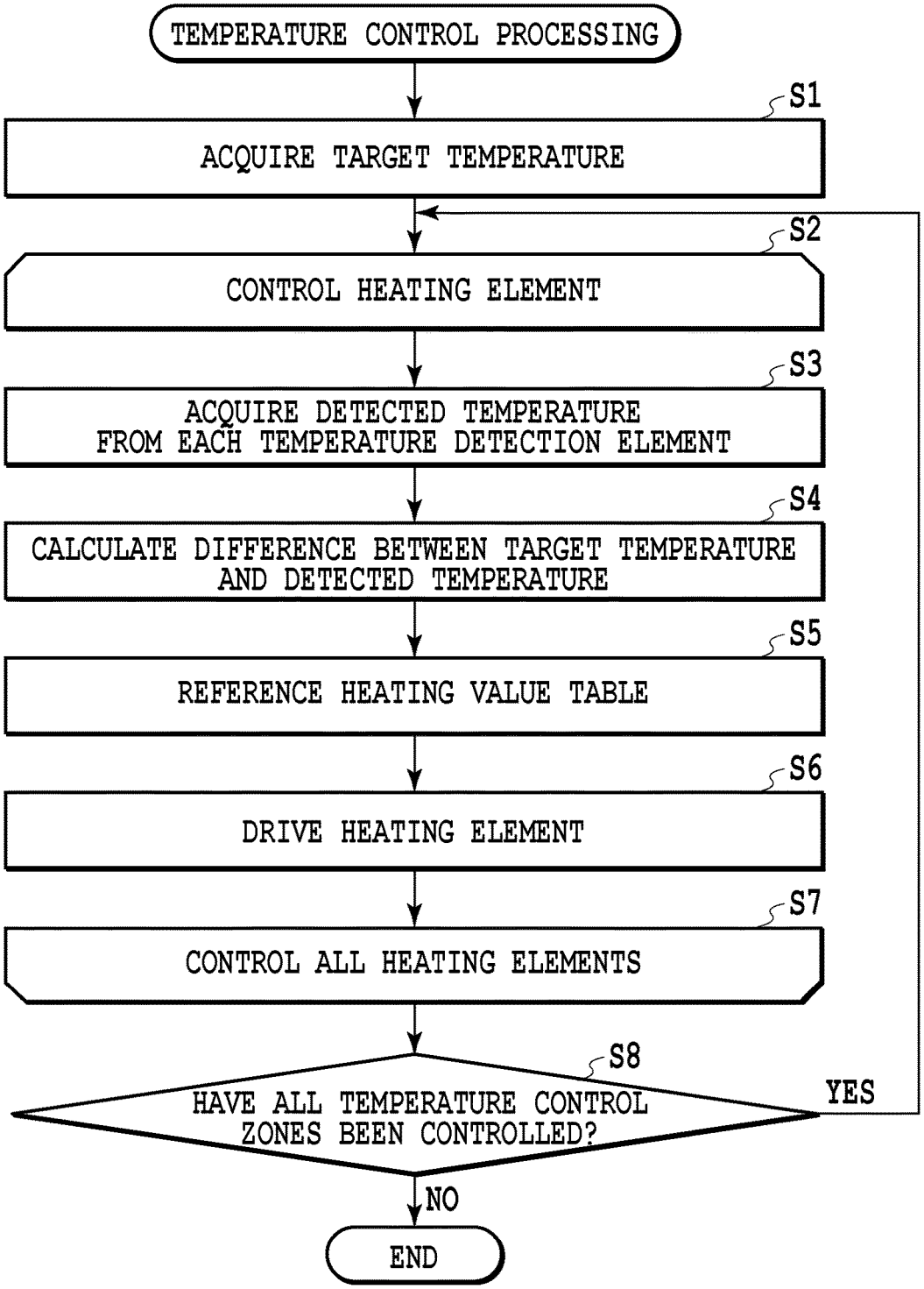
FIG. 5 is a flowchart illustrating temperature control processing in the first embodiment of the present invention.

FIG. 5 is a flowchart illustrating temperature control processing. In a case where a user inputs a printing start signal to the printing apparatus, a temperature control sequence is activated, and first, the target temperature stored in the printing apparatus main body is acquired (step S1). Subsequently, steps S2 to S7 are repeated until controllable driving of the heating elements 5 (5*a*, 5*b*, 5*c*, 5*d*, 5*e*) in temperature control zones corresponding to the heating areas 55 (55*a*, 55*b*, 55*c*, 55*d*, 55*e*) ends.

First, the detected temperature from the temperature detection element 9*a* in the heating area 55*a* is acquired (step S3). The temperature difference (ΔT) between the detected temperature and the target temperature is calculated (step S4). Then, with reference to the reference table in FIG. 4, a reference target ID corresponding to the temperature difference (ΔT) is determined. Moreover, with reference to the heating value table in FIG. 3, the heating value corresponding to the reference target ID is determined (step S5). Then, based on the heating value, the heating element 5*a* corresponding to the temperature detection element 9*a* is driven (step S6). For example, in a case where the target temperature is 40.0° C. and the detected temperature from the temperature detection element 9*a* is 24.6° C., the temperature difference (ΔT) calculated in step S4 is 15.4° C. The reference table in FIG. 4 indicates that the reference target ID corresponding to the temperature difference of 15.4° C. is 25. The heating value table in FIG. 3 indicates that the heating value corresponding to the reference target ID of 25 is 15.6 W. Thus, the heating element 5*a* is driven so as to have a heating value of 15.6 W. In another example, in a case where the target temperature is also 40.0° C. and the detected temperature from the temperature detection element 9*a* is 41.7° C., the temperature difference calculated in step S4 is −1.7° C. In this case, the detected temperature is higher than the target temperature, the reference target ID is "Null", and no driving signal is input to the heating element 5*a*, which thus has a heating value of 0 W. Subsequently, likewise, steps S2 to S7 are repeated so as to controllably drive the heating elements 5*b*, 5*c*, 5*d*, 5*e* in the temperature control zones corresponding to the heating areas 55*b*, 55*c*, 55*d*, 55*e*. The reference table in FIG. 4 is configured to also correspond to heating elements 5*b* to 5*j*.

As described above, the heating value of the heating element 5 is set based on the difference between the target temperature and the detected temperature, and the relation between the heating value of the heating element 5 and the difference between the target temperature and the detected temperature is set to reduce the amplitude of the detected temperature with respect to the target temperature. In the examples in FIG. 3 and FIG. 4, the relation between the temperature difference (ΔT) and the heating value of the heating element 5 is set to also vary the rate of variation in the heating value of the heating element 5 in a case where the temperature difference (ΔT) varies by a given value.

Figure 6:
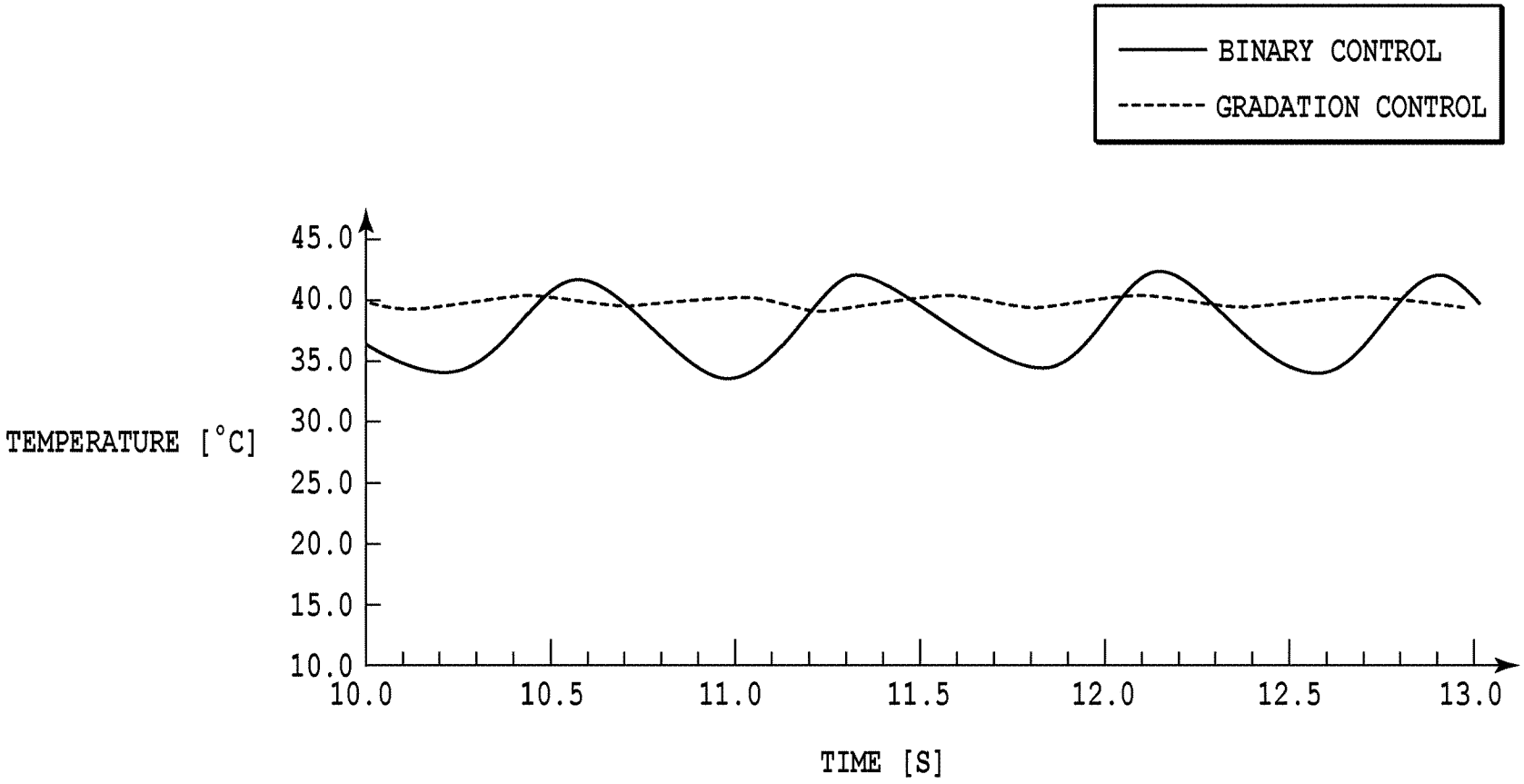
FIG. 6 is a diagram illustrating a different example of temperature control performed on the print head.

FIG. 6 is a diagram of a temporal variation in the temperature of the ink in the pressure chamber in the print head 3. A solid line in FIG. 6 indicates variation in the temperature of the ink in the pressure chamber resulting from what is called binary control. In the binary control, in a case where the detected temperature is lower than the target temperature, the driver connected to the heating element is turned on to generate heat. In a case where the detected temperature is higher than the target temperature, the driver connected to the heating element is turned off to stop heat generation from the heating element. A dotted line in FIG. 6 indicates variation in the temperature of the ink in the pressure chamber resulting from multi-level control in the present embodiment. In the multi-level control, the heating value of the heating element is controlled based on the differential value between the detected temperature and the target temperature, as described above. As is apparent from FIG. 6, in either control, amplitude of the detected temperature with respect to the target temperature of 40° C. is observed, but the multi-level control in the present embodiment involves a smaller variation in the temperature of the ink in the pressure chamber than the binary control. A comparison of samples of actually printed images indicates that the multi-level control in the present embodiment involves a smaller amount of density unevenness than the binary control.

In the present embodiment, the heating value of the heating element 5 is set based on the difference between the target temperature and the detected temperature to controllably adjust the temperature of the printing element substrate and the temperature of the ink in the pressure chamber to within predetermined ranges. This allows ink ejection characteristics to be stabilized and made uniform. The heating value of the heating element 5 can be set by the CPU 1000 or a circuit provided on the printing element substrate or through cooperation thereof using a table as described above. The driver 6 can drive the heating element 5 under the control of the CPU 1000. The heating element for temperature control in the present embodiment is different from the heater serving as the ejection energy generation element. However, the present embodiment is not limited to this. The heater serving as the ejection energy generation element may also have the function of the heating element for temperature control.

Second Embodiment

In the above-described first embodiment, variation in ink ejection characteristics caused by variation in temperature can be controlled for each small range (for each heating area) in the print head 3. The amount of heat transferred may vary among areas of the print head 3 due to a different thermal capacity of surroundings of the heating element and a different thermal effect of another heat source, leading to variation in temperature control response characteristics of the ink. In this case, the ink ejection characteristics of the print head 3 may be locally non-uniform, leading to deteriorated image quality. In particular, in a case where a significant difference is present between the temperature of the environment in which the printing apparatus is installed and the target temperature to which the temperature is controllably adjusted, more significant differences in the temperature control response characteristics of the ink occur among the areas of the print head 3.

Figure 7:
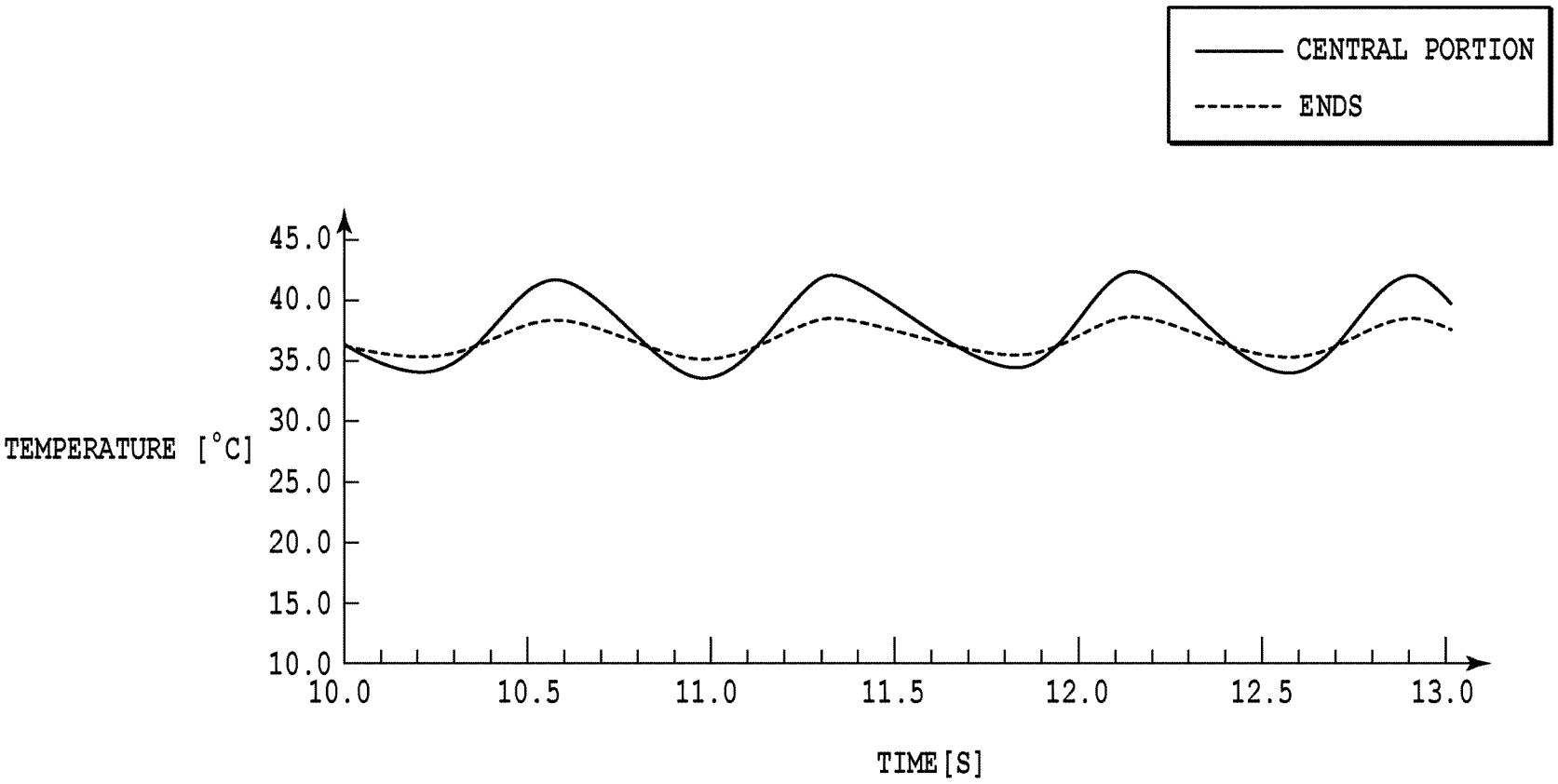
FIG. 7 is a diagram illustrating variation in temperature varying among components of the print head.

FIG. 7 is a diagram of a temporal variation in the temperature of the ink in the pressure chamber in the print head 3. A solid line in FIG. 7 represents variation in the temperature in the heating area 55*c*, positioned in the central portion of the printing element substrate 10. A dotted line in FIG. 7 represents variation in the temperature in the heating areas 55*a*, 55*e*, positioned close to ends of the printing element substrate 10. As is apparent from FIG. 7, amplitude of the temperature with respect to the target temperature is observed both in the central portion and at the ends of the printing element substrate 10. The amount of amplitude is larger in the central portion than at the ends. One reason why the amount of amplitude of the temperature varies with the position in the printing element substrate 10 is that the thermal capacity is smaller in the central portion of the printing element substrate 10 where a central portion of the ink supply port is positioned than at the ends of the printing element substrate 10 where ends of the ink supply port 170 are positioned. Another reason is that, in the central portion of the printing element substrate 10, the heating elements are arranged on the opposite sides in the array direction of the ejection ports, so that much of the heat from the heating elements is transferred to the ink, resulting in relatively increased temperature elevation range.

Figure 8:
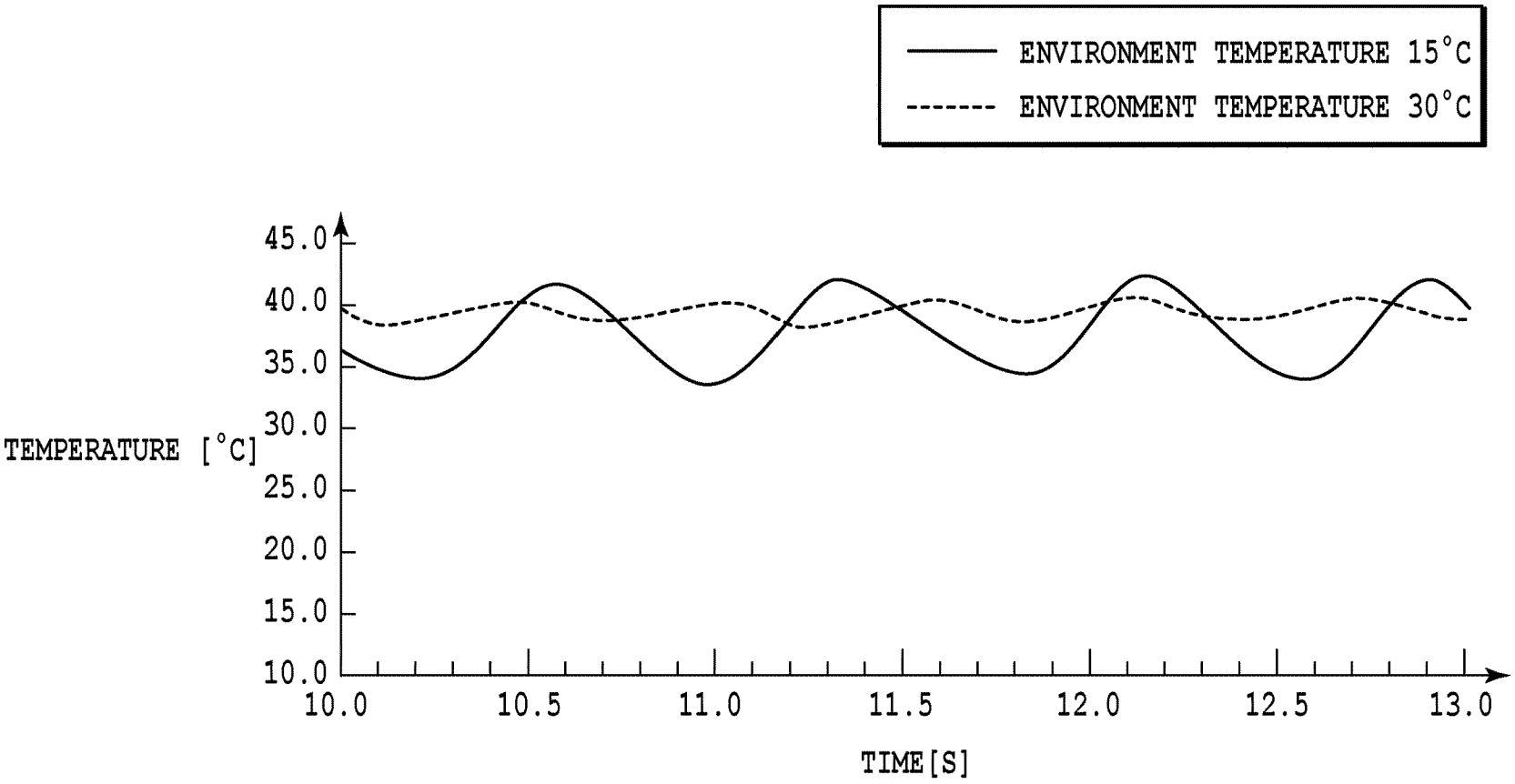
FIG. 8 is a diagram illustrating a relation between an environment temperature and variation in the temperature of the print head.

FIG. 8 is a diagram illustrating effects, on the print head 3, of the temperature of the environment where the printing apparatus is installed. A solid line in FIG. 8 represents a temporal variation in the temperature of the print head 3 observed in a case where the environment temperature is 15° C. A dotted line in FIG. 8 represents a temporal variation in the temperature of the print head 3 observed in a case where the environment temperature is 30° C. In a case where the environment temperature is 15° C., the temperature of the ink fed through the ink supply port 170 is lower than the target temperature. Thus, during the interval between detection timings of the temperature detection element 9, a larger amount of heat is transferred from the heating element 5 to the ink.

As described above, the temperature of the ink in the pressure chamber may overshoot due to the different thermal characteristics of the surroundings of the heating element 5. This is undesirable in printing of high-quality images. Thus, in the present embodiment, the heating value of the heating element 5 corresponding to each temperature detection element 9 is set based on the difference between the detected temperature from the temperature detection element 9 and the target temperature and identifier information on the temperature detection element 9.

Figure 9:
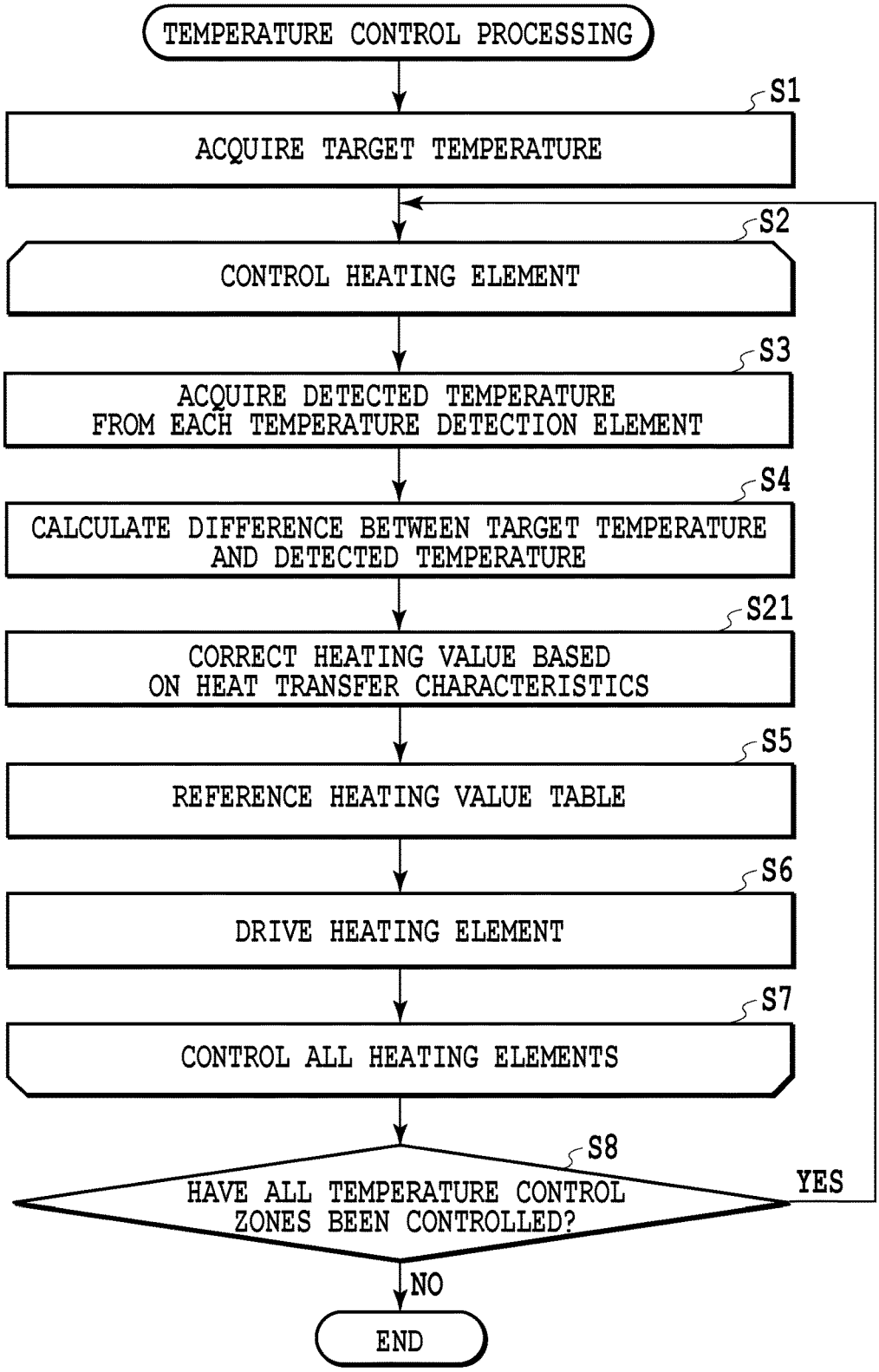
FIG. 9 is a flowchart illustrating temperature control processing in a second embodiment of the present invention.

FIG. 9 is a flowchart illustrating temperature control processing. For portions of the processing similar to the corresponding portions of the processing in the flowchart in FIG. 5 described above, similar step numbers are used and description is omitted. In a case where printing start is selected via a user interface and a printing start signal is input to the apparatus main body, a temperature control sequence is activated, and the target temperature stored in the printing apparatus main body is acquired (step S1). Subsequently, steps S2 to S7 are repeated until controllable driving of each of the heating elements 5 in the temperature control zones corresponding to the heating areas 55 ends. First, the detected temperature is acquired from the temperature detection element 9*a* (step S3), and the difference (ΔT) between the detected temperature and the target temperature is determined (step S4). Subsequently, with reference to a correction table for the heating value in FIG. 10, a correction amount "1" for the heating value of the heating element 5*a* is determined which corresponds to identifier information "1" on the temperature detection element 9*a*. The correction amount "1" for the heating value of the heating element 5*a* is added, as illustrated at a portion (c) of FIG. 11, to the reference target ID corresponding to the heating value of the heating element 5*a* as illustrated at portions (a) and (b) of FIG. 11, to update the reference target ID of the heating element 5*a* as illustrated at a portion (d) of FIG. 11 (step S21). Subsequently, based on the heating value corresponding to the updated reference target ID as illustrated at the portion (d) of FIG. 11, the heating element 5*a* corresponding to the temperature detection element 9*a* is driven (step S6). Subsequently, similarly, steps S2 to S7 are repeated so as to controllably drive the heating elements 5*b*, 5*c*, 5*d*, 5*e* in the temperature control zones corresponding to the heating areas 55*b*, 55*c*, 55*d*, 55*e*.

For example, in a case where the target temperature is 40° C. and the detected temperature from the temperature detection element 9*a* is 28° C., the temperature difference (ΔT) is 12° C. and the correction amount "1" for the heating value is added to the reference target ID "20" of the default heating area 55*a* corresponding to the temperature difference to correct the reference target ID to "21". With reference to the heating value table in FIG. 3 described above, the heating element 5*a* is driven so as to set the heating value of the heating element 5*a* to a heating value of 13.1 W corresponding to the reference target ID "21". In a case where the detected temperature of the temperature detection element 9*b* is 29° C., for the heating area 55*b*, the reference target ID in the portion (b) in FIG. 11 corresponding to a temperature difference (ΔT) of 11° C. is "20", the correction amount in the portion (c) in FIG. 11 is "0", and the heating value in FIG. 3 corresponding to the reference target ID "20" is 12.5 W. Therefore, the heating element 5*b* is allowed to generate heat with a heating value of 12.5 W. In a case where the detected temperature from the temperature detection element 9*c* is 31° C., for the heating area 55*c*, the reference target ID in the portion (b) in FIG. 11 corresponding to a temperature difference (ΔT) of 9° C. is "16", the correction amount in the portion (c) in FIG. 11 is "−1", and the heating value in FIG. 3 corresponding to the reference target ID "15" is 9.4 W. Therefore, the heating element 5*c* is allowed to generate heat with a heating value of 9.4 W. The heating value table in FIG. 11 is configured to correspond to the heating elements 5*b* to 5*i*.

As described above, the heating values of the heating elements 5 are discretely set for each of the components of the print head 3 having different heat transfer characteristics. This allows temperature control to be achieved so as to rapidly heat the print head 3 to the target temperature while suppressing excessive temperature elevation, without the need to increase a circuit scale.

In the present embodiment, for each of the components of the print head 3 having different heat transfer characteristics, the heating values of the heating elements 5 are discretely set based on the difference between the target temperature and the detected temperature. Consequently, the temperature of the printing element substrate and the temperature of the ink in the pressure chamber are controllably adjusted to within the predetermined ranges, allowing the ink ejection characteristics to be stabilized and made uniform. In the present embodiment, the heating value is set higher for the heating elements 5 positioned at the ends of the print head 3 in the array direction of the ejection ports than for the heating elements 5 positioned in the central portion of the print head 3 in the array direction of the ejection ports. However, in principle, for areas having a higher thermal diffusivity than the other areas, the heating value may be set higher than that for the other areas. As long as the principle is followed, the area in the central portion of the print head 3 may have an increased heating value.

Third Embodiment

In the print head in the present embodiment, a plurality of heating areas is associated with one temperature detection element disposed on the printing element substrate. The print head is configured to control the heating elements in a plurality of heating areas based on the detected temperature from one temperature detection element. In a case where the temperature detection element is disposed for each heating area, that is, in a case where as many temperature detection elements as heating areas are disposed, the detected temperature from the temperature detection element has a longer sampling period. This increases the time from one temperature control process until the next temperature control process, possibly reducing the accuracy of the temperature control. Thus, in the present embodiment, the heating elements in a plurality of heating areas are controlled based on the detected temperature from one temperature detection element. Consequently, the sampling period of the detected temperature is reduced to increase the accuracy of the temperature control.

Since the heating areas have different thermal characteristics as described above, the state of excessive temperature elevation executed by the heating elements varies among the heating areas. However, the variation in thermal characteristics within the printing element substrate is not excessively significant, and thus, setting larger heating areas enables a reduction in the number of disposed temperature detection elements corresponding to the heating areas.

Figure 12:
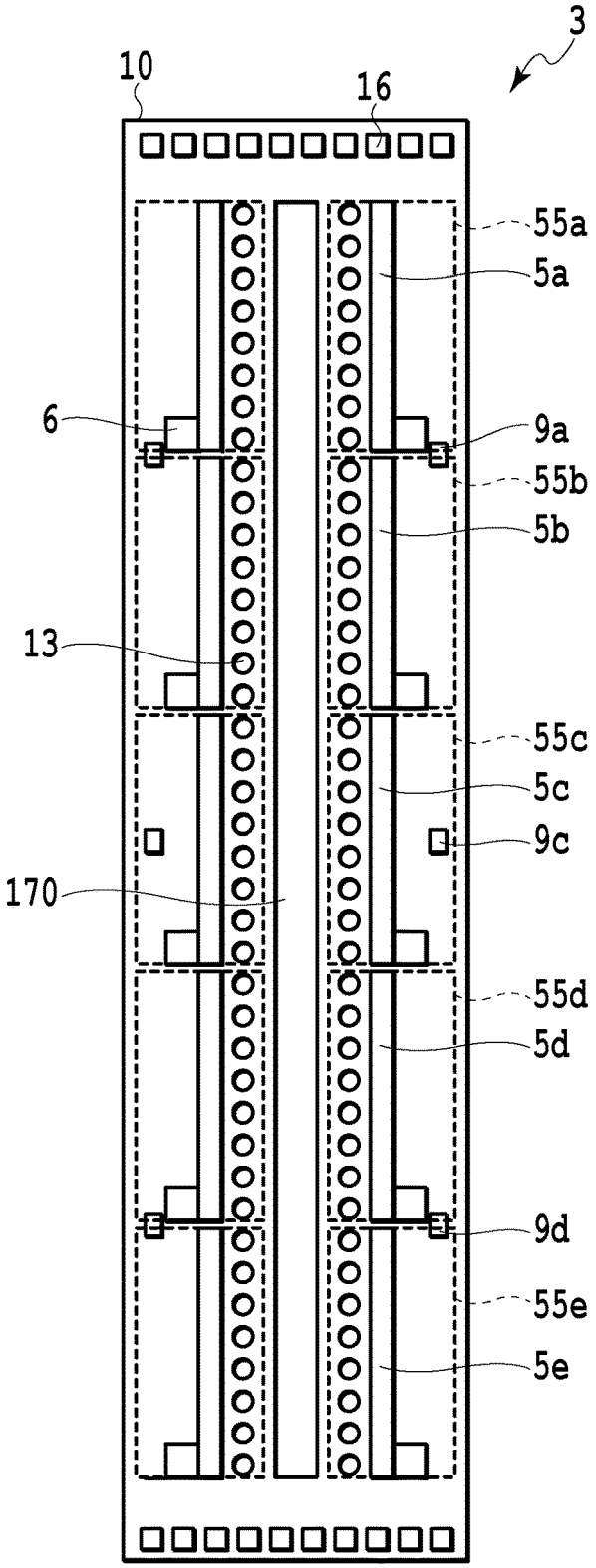
FIG. 12 is a diagram illustrating a printing element substrate in a third embodiment of the present invention.

Specifically, the print head includes the temperature detection element 9*c* that detects the temperature in the central portion of the printing element substrate 10 and the temperature detection elements 9*a*, 9*d* that detect the temperatures at the ends of the printing element substrate 10, as depicted in FIG. 12. The temperature detection element 9*a* detects temperatures for temperature control performed on the heating areas 55*a* and 55*b*. The temperature detection element 9*d* detects temperatures for temperature control performed on the heating areas 55*d* and 55*e*. The heating area 55*d* has heat transfer characteristics corresponding to the intermediate region between the heat transfer characteristics of the heating area 55*c* and the heat transfer characteristics of the heating area 55*e*. Thus, the excessive temperature elevation in the heating area 55*d* can be limited to within an acceptable range by setting the heating value of the heating element 5*d* in the heating area 55*d* based on the detected temperatures from the temperature detection element 9*c* and 9*d*.

For example, in a case where the target temperature is 40° C., the detected temperature from the temperature detection element 9*c* is 32.0° C., and the detected temperature from the temperature detection element 9*d* is 28.4° C., the heating element 5*d* in the heating area 55*d* is controlled using the average value of 30.2° C. for the temperature detection elements 9*c* and 9*d*. In this case, the heating value is corrected for each heating area as is the case with the second embodiment. That is, for the heating area 55*c*, the reference target ID at the portion (b) in FIG. 11 corresponding to a temperature difference (ΔT) of 8° C. (=40−32) is "16", the correction amount at the portion (c) in FIG. 11 is "−1", and the heating value in FIG. 3 corresponding to the reference target ID "15" (=16−1) is 9.4 W. For the heating area 55*d*, the reference target ID at the portion (b) in FIG. 11 corresponding to a temperature difference (ΔT) of 9.8° C. (=40−30.2) is "16", the correction amount at the portion (c) in FIG. 11 is "0", and the heating value in FIG. 3 corresponding to the reference target ID "16" is 10.0 W. Such temperature control is repeated until a printing operation based on print data is completed.

As described above, in the present embodiment, the number of temperature detection elements disposed is set smaller than that of heating areas to enable an increase in the sampling frequency and resolution of the detected temperature, allowing high-quality images to be continuously printed. In the present embodiment, the temperature detection elements are each disposed between the heating areas intended for the same temperature control. However, the disposition position of the temperature detection element may be a position where the temperature in the heating area having the same heat transfer characteristics as those of the control target heating area can be typically detected. For example, the temperature detection element may be disposed in any of a plurality of the heating areas having the same heat transfer characteristics. In a case where a plurality of heating areas intended for the same temperature control are not adjacent to each other, if the effect of a difference in the heat transfer characteristics of the plurality of heating areas on fluctuation in ink ejection characteristics falls within an acceptable range, the temperature detection element may be disposed in any one of the plurality heating areas even in a case where the heating area in which the temperature detection element is disposed lies away from the other heating area. The present embodiment is not limited to the configuration using the average value of the detected temperatures from the two temperature detection elements. For example, a value may be used which results from multiplication of the detected temperature from one temperature detection element by a coefficient. Alternatively, a value may be used which is obtained by multiplying each of the detected temperatures from a plurality of the temperature detection elements by the coefficient, summing the resultant products, and dividing the sum by the number of the detected temperatures.

Fourth Embodiment

In the present embodiment, a plurality of the temperature detection elements is disposed for each heating area in the printing element substrate. A typical temperature is derived from the detected temperatures from the temperature detection elements so that temperature control is performed on the heating area based on the typical temperature.

The following case is assumed: in a configuration in which each heating area is large so that the number of temperature detection elements is equal to or smaller than that of heating areas, ink is ejected through only some of the ejection ports in the heating area. In this case, the detected temperature from the temperature detection element varies according to the distance between the temperature detection element and the ejection port through which the ink is ejected.

For example, the apparatus may determine that, even though the temperature of the ink in the pressure chamber is high, the long distance between the pressure chamber and the temperature detection element makes the temperature of the ink in the pressure chamber equal to or lower than the target temperature, and thus allow the heating element to generate heat, leading to an excessive temperature elevation state.

Figure 13:
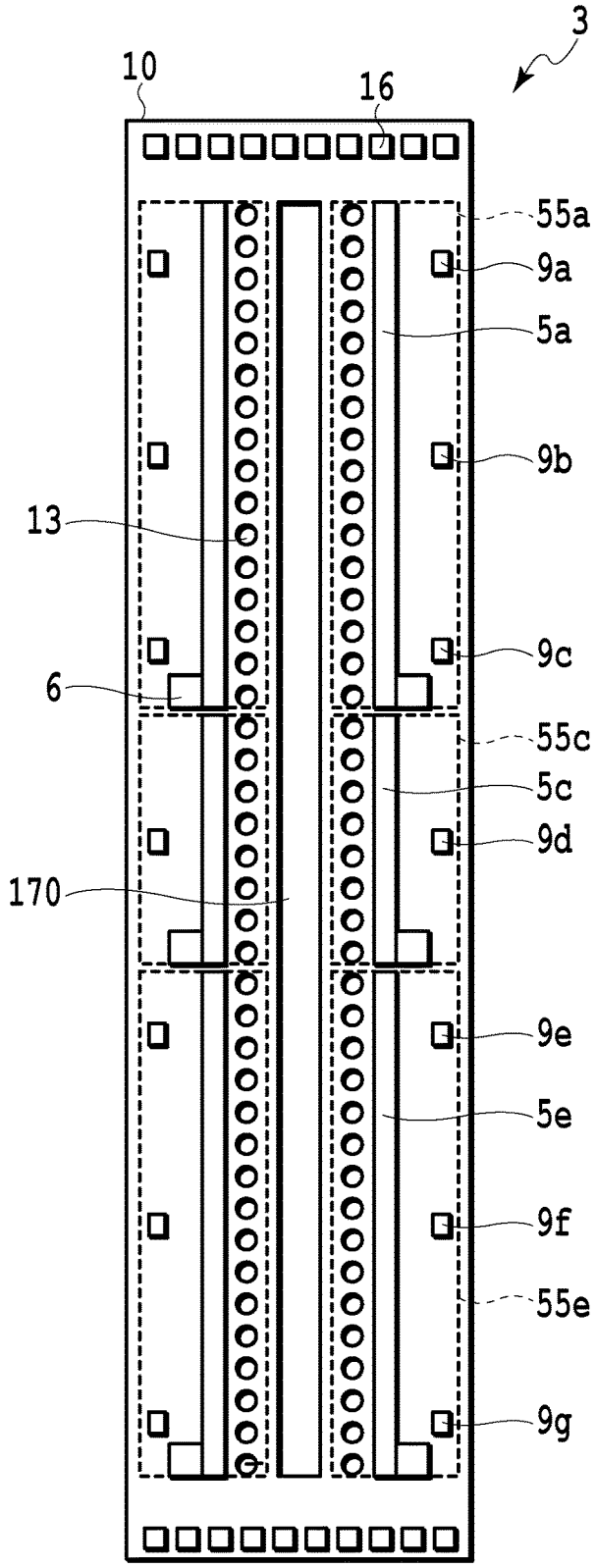
FIG. 13 is a diagram illustrating a printing element substrate in a fourth embodiment of the present invention.

Thus, in the present embodiment, the number of temperature detection elements disposed is set according to the size of the heating area. In the example in FIG. 13, the heating area 55*a* is relatively large, and three temperature detection elements 9*a*, 9*b*, 9*c* are disposed in the heating area 55*a*. Similarly, the heating area 55*e* is also relatively large, and three temperature detection elements 9*e*, 9*f*, 9*g* are disposed in the heating area 55*e*. The heating area 55*c* is relatively small, and one temperature detection element 9*c* is disposed in the heating area 55*c*.

Figure 14:
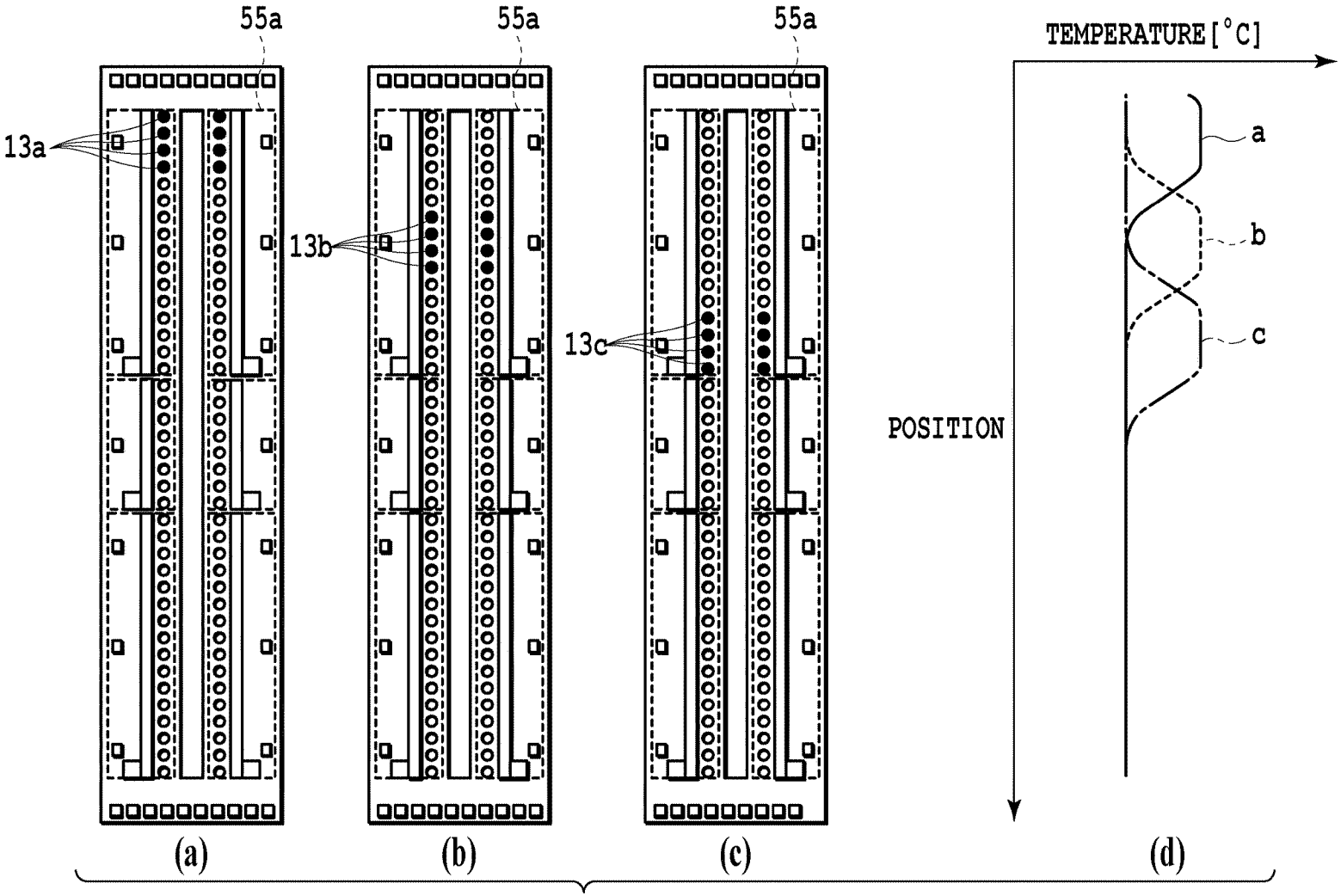
FIG. 14 is a diagram illustrating a relation between a temperature distribution of the print head and the position of an ejection port through which ink is ejected.

FIG. 14 is a diagram illustrating a relation between the position of the ejection ports 13 in the heating area 55*a* through which the ink is ejected and a temperature distribution of the heating area 55*a*. In a case where, in the heating area 55*a*, the ink is ejected through the ejection ports 13*a* positioned close to the pad 16, as illustrated at a portion (a) in FIG. 14, the temperature distribution of the heating area 55*a* is expressed as a curve (a) in the portion (d) in FIG. 14. In a case where the ink is ejected through the ejection ports 13*b* positioned in the central portion in the heating area 55*a*, as illustrated at a portion (b) in FIG. 14, the temperature distribution of the heating area 55*a* is expressed as a curve (b) in the portion (d) in FIG. 14. In a case where the ink is ejected through the ejection ports 13*c* positioned below, in FIG. 14, the central portion in the heating area 55*a*, as illustrated at a portion (c) in FIG. 14, the temperature distribution of the heating area 55*a* is expressed as a curve (c) in the portion (d) in FIG. 14. As is apparent from the portion (d) in FIG. 14, energy is locally input to electrothermal transducing elements such as heaters based on the positions of the ejection ports through which the ink is ejected, in order to allow the ink to be ejected. Thus, a temperature distribution is generated based on the positions of the ejection ports through which the ink is ejected. Therefore, possible bias of the temperature distribution can be reduced by averaging the detected temperatures from the temperature detection elements 9*a*, 9*b*, 9*c* in the heating area 55*a* and performing temperature control on the heating area 55*a* using the average value.

As described above, in the present embodiment, the number of temperature detection elements disposed is increased with respect to the number of heating areas to set smaller temperature detection ranges in the heating area. This enables an increase in the spatial resolution of temperature control to allow high-quality images to be continuously printed.

Fifth Embodiment

Figure 15:
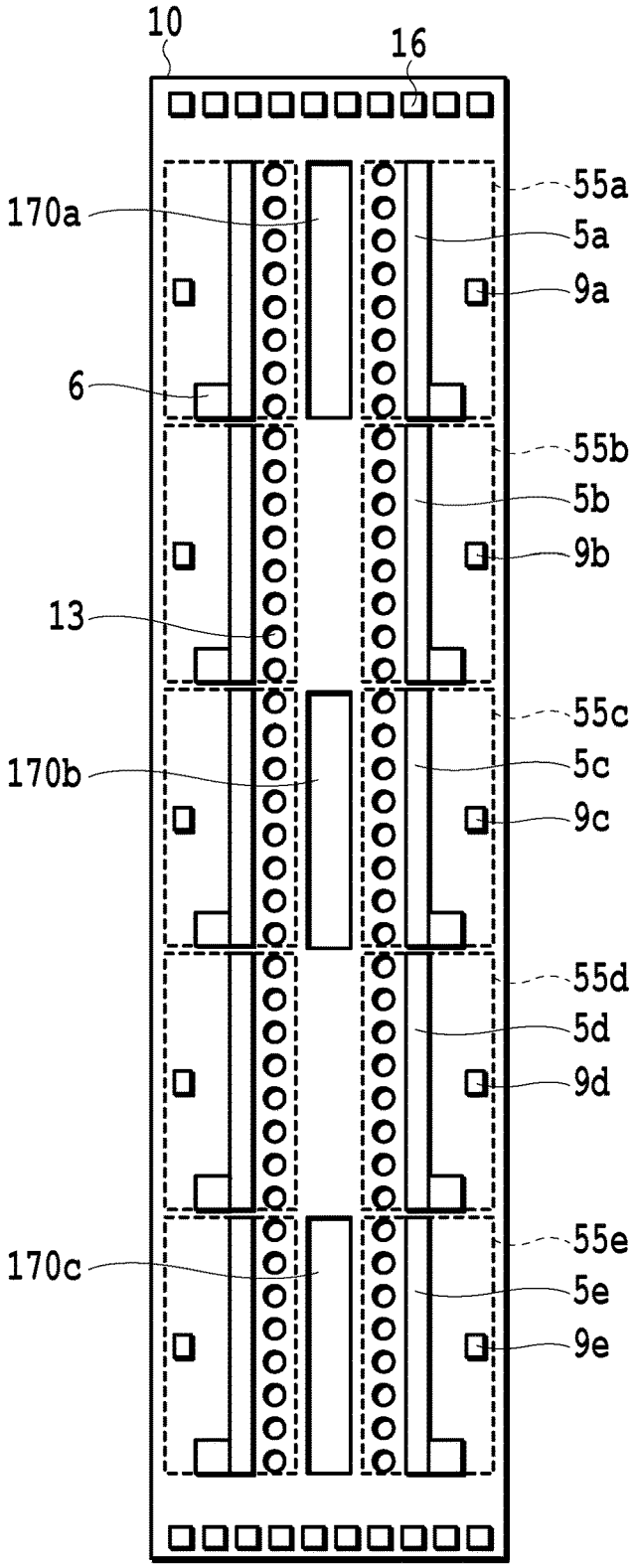
FIG. 15 is a diagram illustrating a printing element substrate in a fifth embodiment of the present invention.

In the present embodiment, a plurality of ink supply ports is formed in the printing element substrate. Specifically, as depicted in FIG. 15, three ink supply ports 170 (170*a*, 170*b*, 170*c*) are formed. During a process in which the ink flows from the ink supply ports 170 to the pressure chambers, heat is transferred from the printing element substrate 10 to the ink. Thus, the ink in the pressure chambers away from the ink supply ports is likely to be higher in temperature than the ink in the pressure chambers near the ink supply ports. In other words, compared to the ink in the pressure chambers positioned on an upstream side of an ink supply path, the ink in the pressure chambers positioned on a downstream side of the ink supply path is likely to be hotter. Such a temperature difference may lead to a difference in ink ejection characteristics, resulting in deteriorated printing quality of images.

In the present embodiment, the temperature control is varied between the heating areas 55*a*, 55*c*, 55*e* near the ink supply ports 170 (170*a*, 170*b*, 170*c*) and the heating areas 55*b*, 55*d* away from the ink supply ports 170. Specifically, the temperature difference (ΔT) between the detected temperature from the temperature detection element 9 and the target temperature is determined, and the correction amount for the heating value of the heating element 5 corresponding to the temperature detection element 9 is determined based on the identifier information on the heating element 5, as is the case with the above-described second embodiment. The default heating value of the heating element 5 corresponding to the temperature detection element 9 is corrected using the correction amount. The heating element 5 is driven based on the corrected heating value. In the present embodiment, the correction amount for the heating value of the heating element 5 in the heating area near the ink supply port 170 is set much larger than the correction amount for the heating value of the heating element 5 in the heating area away from the ink supply port 170. Specifically, as illustrated in FIG. 16, the correction amount is "1" for the heating elements 5*a*, 5*c*, 5*e* in the heating areas 55*a*, 55*c*, 55*e* near the ink supply ports 170. And the correction amount is "0" for the heating elements 5*b*, 5*d* in the heating areas 55*b*, 55*d* away from the ink supply ports 170. Therefore, in a case where the temperature difference (ΔT) between the detected temperature and the target temperature is the same for all the heating areas 55, the heating value of the heating elements 5*a*, 5*c*, 5*e* is larger than the heating value of the heating elements 5*b*, 5*d*.

As described above, the heating values of the heating elements are discretely controlled for each of the components of the printing element substrate having different heat transfer characteristics due to a channel structure for the ink. This enables a reduction in possible bias of the temperature distribution in the printing element substrate. In the present embodiment, the ink supply ports are associated with the heating areas on a one-to-one basis. However, the ink supply ports may be associated with the heating areas on an n-to-one basis or a one-to-n basis. In other words, any association may be used so long as the association enables a reduction in possible bias of the temperature distribution caused by a difference in heat transfer characteristics. The number of ink supply ports 170 is not limited to three but is optional.

Sixth Embodiment

In the present embodiment, the heating values of the heating elements are discretely controlled for each of the components of the printing element substrate having different heat transfer characteristics due to the channel structure for the ink, as is the case with the fifth embodiment. In the present embodiment, a portion of the ink supplied to the print head 3 is collected from the print head 3 after passing through all the pressure chambers.

Figure 17A:
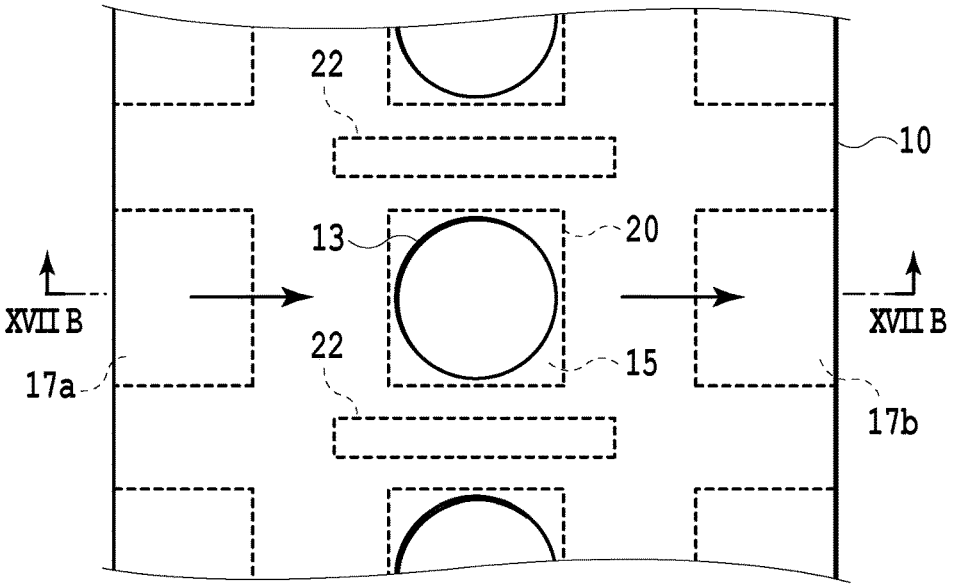
FIG. 17A is a diagram illustrating a print head in the sixth embodiment in the present invention.
Figure 17B:
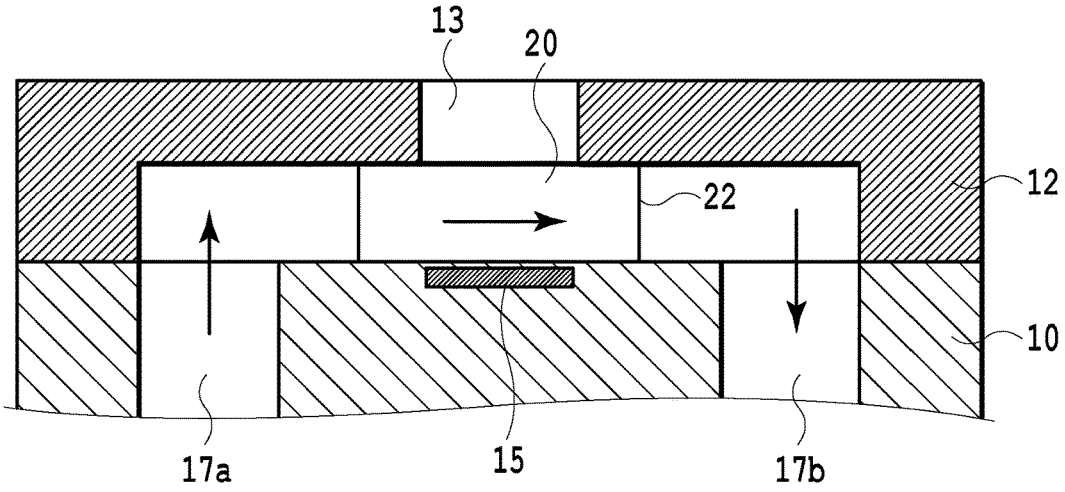
FIG. 17B is a sectional view taken along line XVIIB-XVIIB in FIG. 17A.

FIG. 17A is a plan view of the printing element substrate 10 viewed from the ejection port 13. FIG. 17B is a sectional view taken along line XVIIB-XVIIB in FIG. 17A. A heater 15 serving as an electrothermal transducing element and a pressure chamber 20 have such a positional relation as depicted in FIG. 17A. The ink in the pressure chamber 20 is bubbled by heat generation from the heater 15 so that the resultant bubbling energy can be utilized to eject the ink through the ejection port 13. A partition wall 22 is provided between the adjacent pressure chambers 20 in the array direction of the ejection ports 13. The printing element substrate 10 is provided with a discrete supply path 17*a* through which the ink is supplied to the pressure chamber 20 and a discrete collection path 17*b* through which the ink in the pressure chamber 20 is collected. In FIG. 17A and FIG. 17B, one discrete supply path 17*a* and one discrete collection path 17*b* are formed in association with one pressure chamber 20. The ejection port 13 is formed in an ejection port formation member 12 that is one component of the printing element substrate 10.

The printing element substrate 10 includes a plurality of combinations of each of the discrete supply path 17*a*, the pressure chamber 20, and the discrete collection path 17*b*. In a case where the heater 15 is inactive, the ink is fed to the pressure chamber 20 through the discrete supply path 17*a* and then to the outside of the printing element substrate 10 via the discrete collection path 17*b* for collection. In the present embodiment, such a flow of the ink allows a circulating flow of the ink to be continuously generated not only while the heater 15 is not driven but also while the heater 15 is being driven to eject the ink. In other words, the heater 15 is driven with the ink flowing through the pressure chamber 20 to eject the ink through the ejection port 13.

Figure 18A:
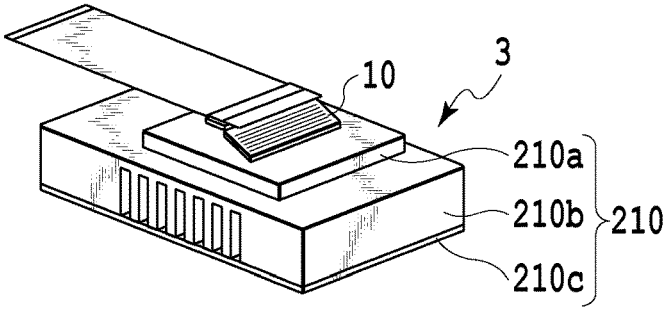
FIG. 18A is a perspective view of the print head in FIG. 17A.
Figure 18B:
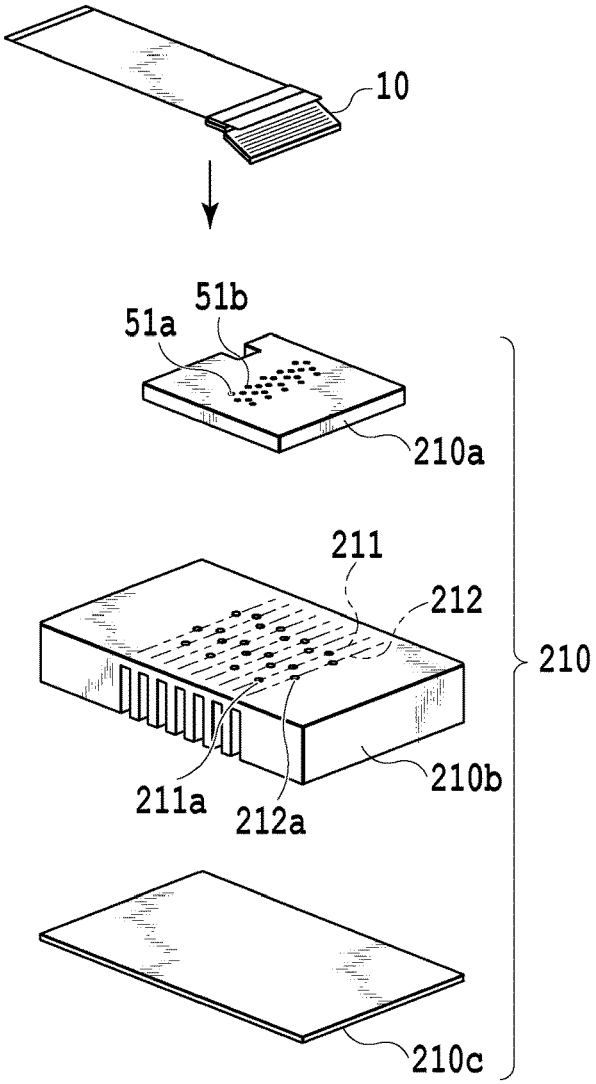
FIG. 18B is an exploded perspective view of the print head.
Figure 19:
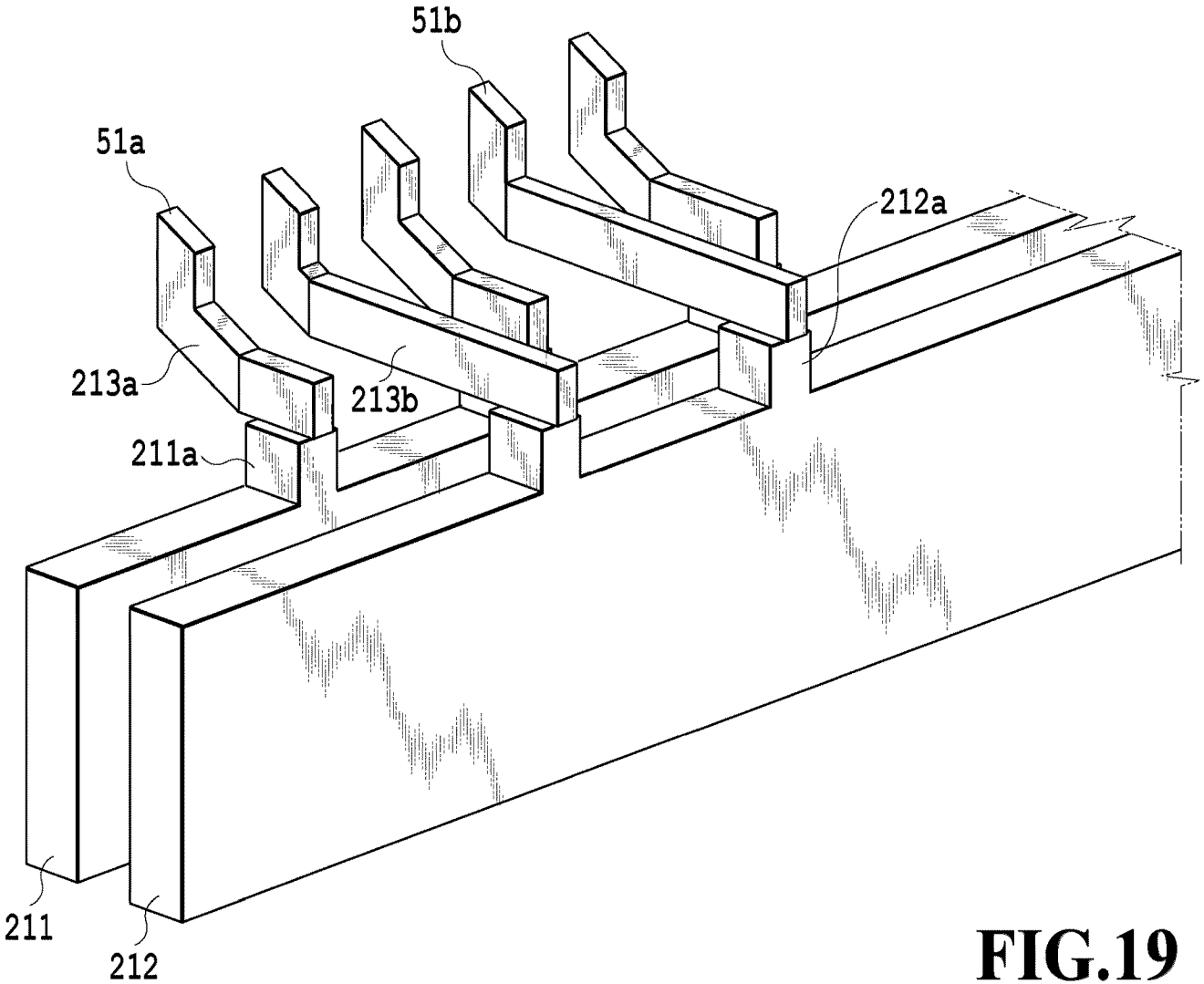
FIG. 19 is a diagram illustrating a supply path for ink in the print head in FIG. 17A.
Figure 21:
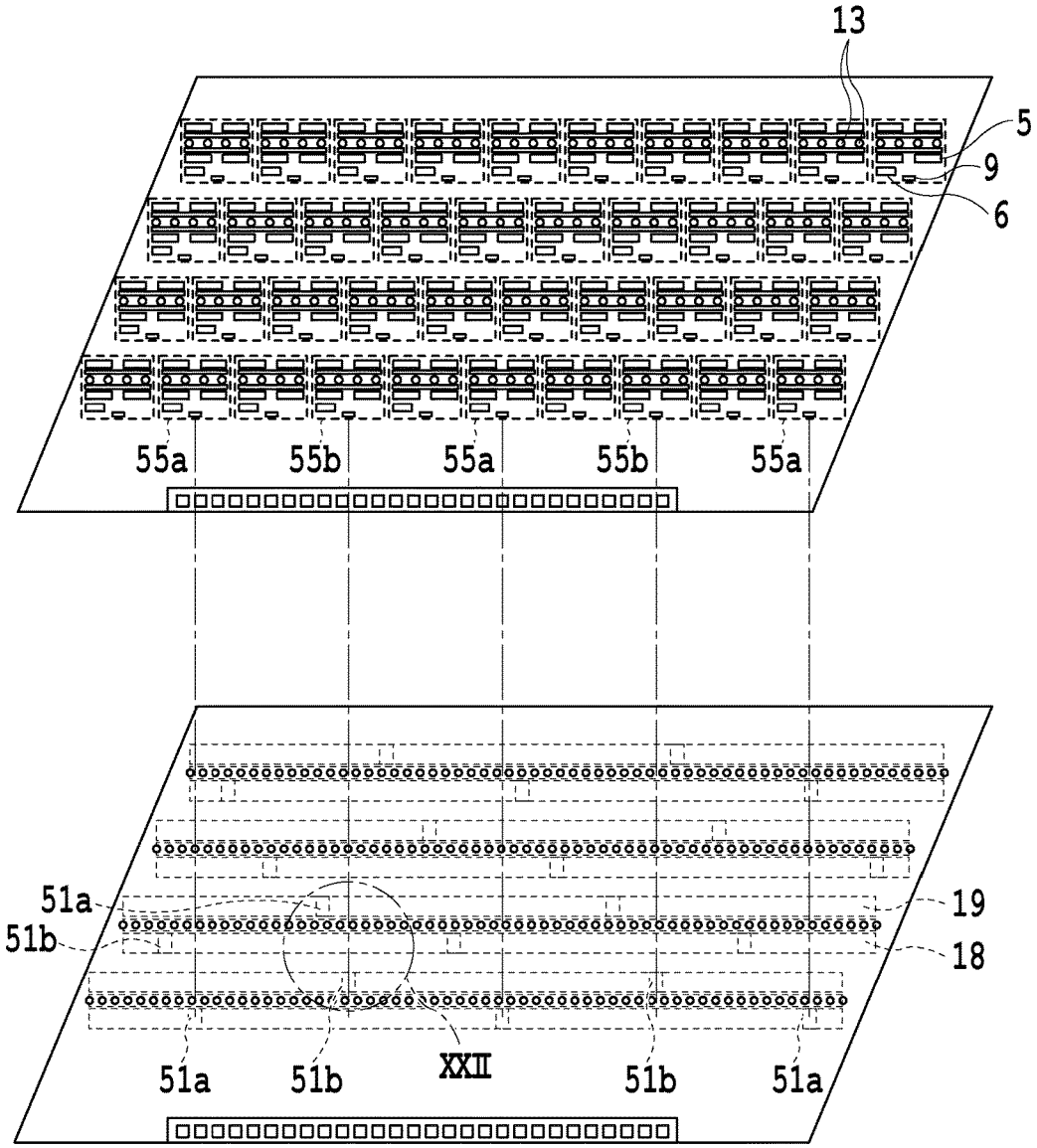
FIG. 21 is a diagram illustrating a positional relation between temperature detection elements and heating elements in the print head in FIG. 17A.
Figure 22:
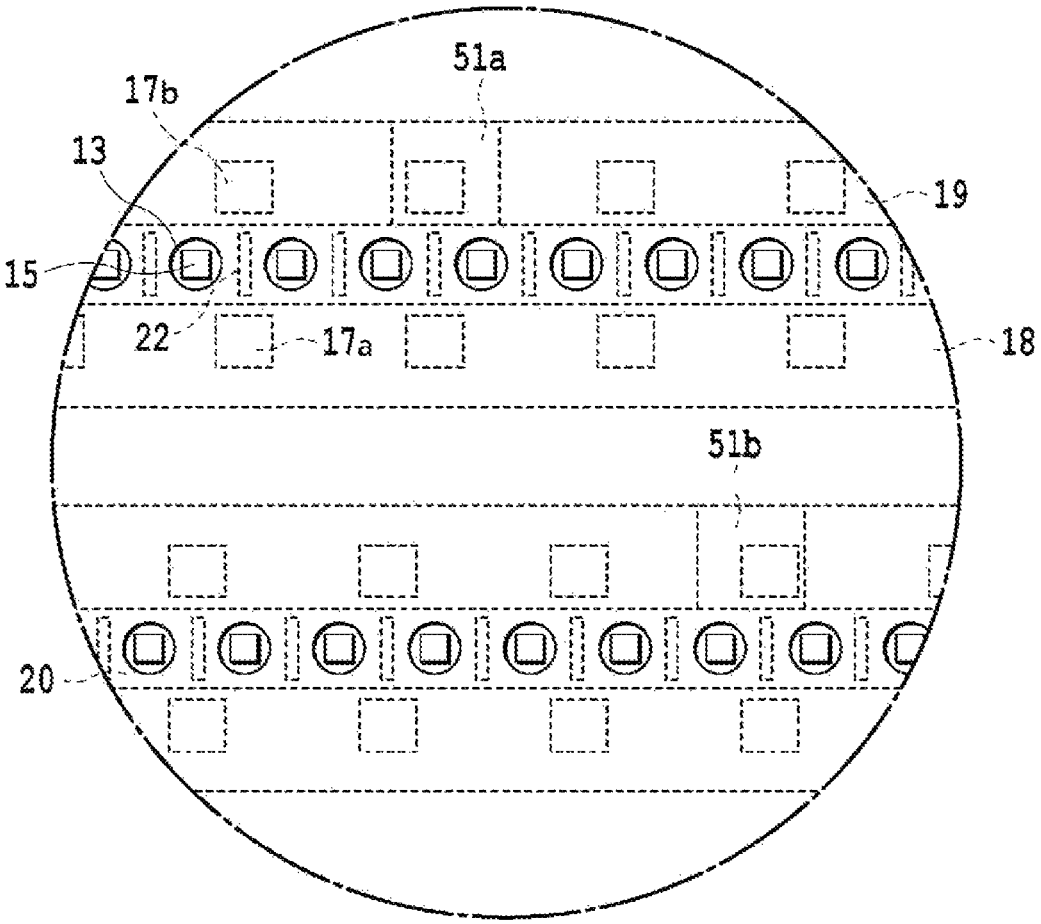
FIG. 22 is a diagram illustrating a positional relation between the supply path and a collection path for ink in the print head in FIG. 17A.

FIG. 18A is a perspective view of an example of the print head 3, and FIG. 18B is an exploded perspective view of the print head 3. The print head 3 includes at least the printing element substrate 10 and a support member 210 that supports the printing element substrate 10. The support member 210 in the present example includes three members 210*a*, 210*b*, and 210*c*. The support member 210 may have any number of components. In other words, any number of components may be provided so long as the components allow the ink to be supplied to and circulated through the printing element substrate 10. FIG. 19 three-dimensionally depicts, among other ink channels for a plurality of colors formed in the print head 3, a common supply path 211, a common collection path 212, a branching supply path 213*a*, and a branching collection path 213*b* for ink of one color. In FIG. 21 and FIG. 22, the ejection ports 13 are arranged so as to form four ejection port arrays, and one discrete supply path 17*a* and one discrete collection path 17*b* are associated with two pressure chambers 20.

As depicted in FIG. 18B, the support member 210*b* is provided with the common supply path 211 and the common collection path 212 extending along the ejection port array as depicted by an alternate long and two short dashes line in FIG. 18B, and communication components 211*a* and 212*a* communicating with the common supply path 211 and the common collection path 212. The support member 210*a* is provided with the branching supply path 213*a*, a communication hole 51*a* communicating with the branching supply path 213*a*, the branching collection path 213*b*, and a communication hole 51*b* communicating with the branching collection path 213*b*. The printing element substrate 10 is provided with a supply path 18 and a collection path 19 extending along the ejection port array, the discrete supply path 17*a* communicating with the supply path 18, and the discrete collection path 17*b* communicating with the collection path 19, as depicted in FIG. 22. The common supply path 211 communicates with the discrete supply path 17*a* through the communication portion 211*a*, the branching supply path 213*a*, the communication hole 51*a*, and the supply path 18. Therefore, through the series of channels, the ink in the common supply path 211 is fed into the pressure chamber 20 via the discrete supply path 17*a*. The common collection path 212 communicates with the discrete collection path 17*b* through the communication portion 212*a*, the branching collection path 213*b*, the communication hole 51*b*, and the collection path 19. Therefore, through the series of channels, the ink in the pressure chamber 20 is collected in the common collection path 212 via the discrete collection path 17*b*.

In a case where the configuration is adopted in which the ink is circulated through the pressure chamber 20, constantly fresh ink can be fed into the pressure chamber 20 to maintain ink components in the pressure chamber constant. On the other hand, due to a pressure difference between the communication holes 51*a*, 51*b*, in a case where the ink is fed into the pressure chamber 20 as a result of ejection of the ink through the ejection ports 13, the ratio between the amount of ink fed through the communication hole 51*a* and the amount of ink fed through the communication hole 51*b* may vary with the position in the pressure chamber 20, leading to imbalanced ink supply. That is, since fresh ink is fed through the communication hole 51*a*, a significant temperature difference is likely to be present between an area in the print head 3 where the pressure chamber 20 is positioned near the communication hole 51*a* and an area in the print head 3 where the pressure chamber 20 is positioned away from the communication hole 51*a*. The temperature difference is particularly significant in a case where a great difference is present between the temperature of the ink flowing in through the communication hole 51*a* and the target temperature for portions of the ink and the printing element substrate 10 near the pressure chamber 20 which temperature is to be achieved by the heating element 5 in order to make the ink ejection characteristics constant.

Figure 20:
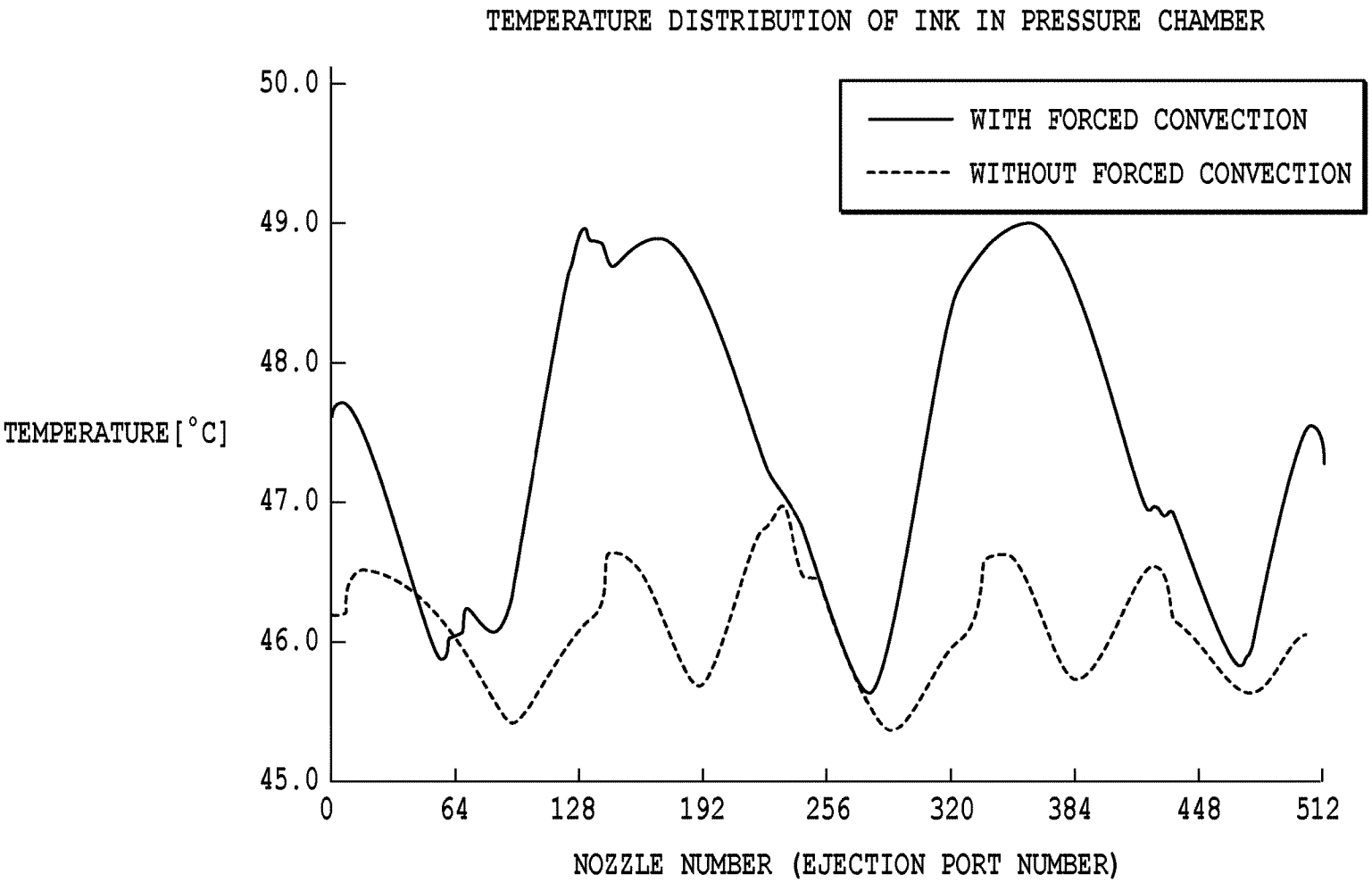
FIG. 20 is a diagram illustrating the temperature distribution of the print head in FIG. 17A.

FIG. 20 is a diagram of a temperature distribution of the ink in the pressure chamber near the ejection port 13. The print head in the present example is provided with the ejection ports 13 the number of which corresponds to nozzle numbers 0 to 511. A solid line in FIG. 20 represents a temperature distribution obtained in a case where the ink is forcedly fluidized as in the present embodiment. A dotted line in FIG. 20 represents a temperature distribution obtained in a case where the ink is not forcedly fluidized. As is apparent from FIG. 20, a configuration with forced convection has a temperature difference approximately 2° C. higher than a temperature difference in a configuration without forced convection.

In the present embodiment, temperature controls for the heating areas 55*a* and 55*b* are discretely performed as illustrated in FIG. 21 in order to reduce the temperature difference between an area in the print head 3 near the communication hole 51*a* and an area in the print head 3 away from the communication hole 51*a*. The heating area 55*a* is an area containing the communication hole 51*a* communicating with the branching supply path 213*a*. The heating area 55*b* is an area containing the communication hole 51*b* communicating with the branching correction path 213*b*.

In the heating area in the print head 3, the temperature detection element 9 and the heating element 5 are disposed as in the case of the above-described embodiment, as depicted in FIG. 21. As is the case with the above-described embodiment, the correction table for the heating value is referenced based on the identifier information corresponding to each heating area. Then, the default heating value of the heating element 5 corresponding to the temperature difference between the detected temperature from the temperature detection element 9 and the target temperature is corrected based on the correction amount in the correction table. Such temperature control for each heating area allows the ink ejection characteristics of the heating areas to be made constant. That is, the heating value of the heating element 5 in the heating area near the communication hole 51*a* having a relatively low temperature near the ejection port can be set larger than the heating value of the heating element in the heating area near the communication hole 51*b* having a relatively high temperature near the ejection port.

In the present embodiment, in a case where a temperature difference occurs in the print head in the configuration in which the ink is forcedly circulated through the pressure chamber, the heating values for the heating areas are discretely controlled to enable a reduction in the bias of the temperature distribution in the printing element substrate. In the present embodiment, the communication holes 51 positioned on an outer edge side of the printing element substrate are ink-supply-side communication holes 51*a*. However, in a case where temperature control can be performed suitably for each heating operation, the communication holes 51 positioned on the outer edge side of the printing element substrate may be ink-collection-side communication holes 51*b*. The numbers of communication holes 51*a*, 51*b* are optional.

Seventh Embodiment

In the present embodiment, the heating values of the heating elements are discretely controlled for each of the components of the print head 3 having different heat transfer characteristics due to the structure of the print head 3 and the ink channel as is the case with the above-described embodiment. In the present embodiment, fluctuation of the heating value resulting from a manufacturing variation among the heating elements is corrected.

In a case where the resistance value varies among the heating elements during a process of manufacturing the printing element substrate, the heating elements have different heat generation capabilities and different heating values. In a case where, in spite of fluctuation of the heating value among the heating elements, the same signal is input from the printing apparatus main body as a control signal for the heating elements, reducing the bias of the temperature distribution in the printing element substrate is difficult. As described above, in a case where the heating elements are varied in electrical characteristics during manufacture of the printing element substrate, temperature control performance is deteriorated.

Thus, in the present embodiment, the temperature control performance is enhanced by correcting the heating values of the heating elements 5 based on electrical characteristics information on the printing element substrate 10.

Figure 23:
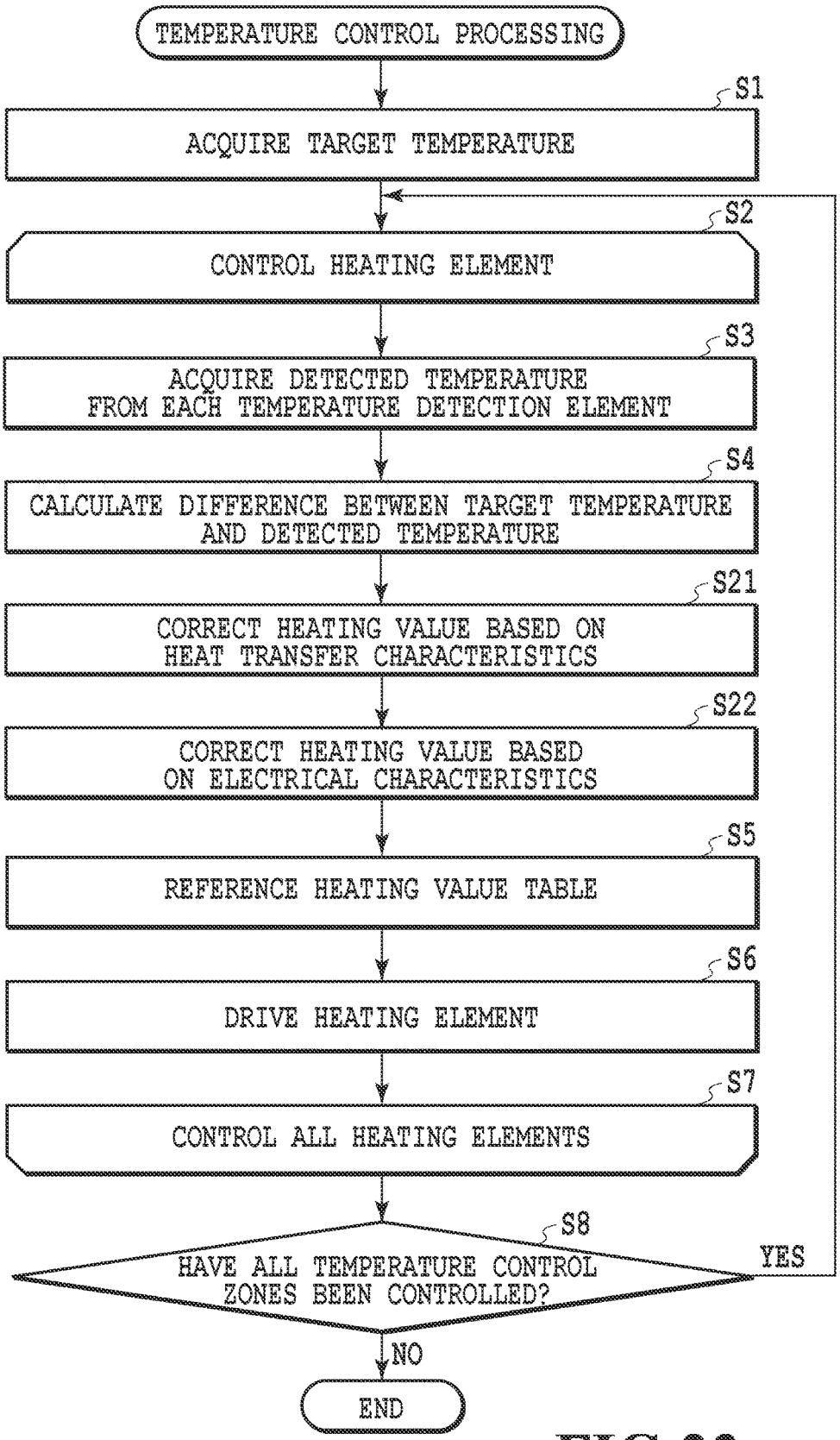
FIG. 23 is a flowchart illustrating temperature control processing in a seventh embodiment of the present invention.

FIG. 23 is a flowchart illustrating temperature control processing in the present embodiment. For portions of the processing similar to the corresponding portions of the processing in the flowchart in FIG. 9 described above, similar step numbers are used and description is omitted. In the present embodiment, in step S22, the reference target for the heating value in the heating value table in FIG. 3 is corrected based on the electrical characteristics information on the heating element 5. Then, the heating value for the corrected reference target is set to be the heating value for the heating element 5. As described above, the reference target in the heating value table is changed in accordance with the electrical characteristics information on the heating element 5. Thus, the heating elements 5 having an electrical variation are allowed to have a uniform heating value (heat generation energy). Therefore, the ink ejection characteristics can be made constant without complicating the temperature control.

As described above, in the present embodiment, the reference target in the heating value table is changed according to a variation in electrical characteristics among the heating elements to enable a reduction in the bias of the temperature distribution in the printing element substrate. Such a method for correcting the heating value of the heating element may be a method for varying the magnitude of the driving voltage to be applied to the heating element or a method for varying the time (the length of a driving pulse) for which current is input to the heating element. In other words, any method may be used so long as the method enables the heating value to be varied.

Eighth Embodiment

In the present embodiment, the heating values of the heating elements are discretely controlled as is the case with the above-described embodiment. In the present embodiment, a plurality of the printing element substrates 10 is disposed in the print head 3.

Figure 24A:
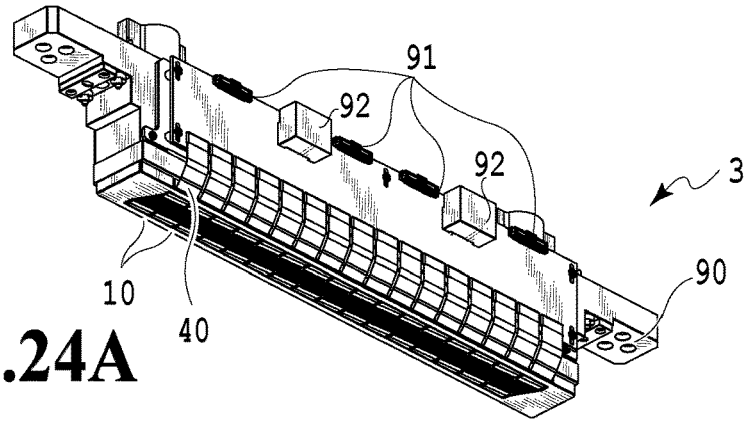
FIG. 24A is a perspective view of a print head in a seventh embodiment of the present invention.
Figure 24B:
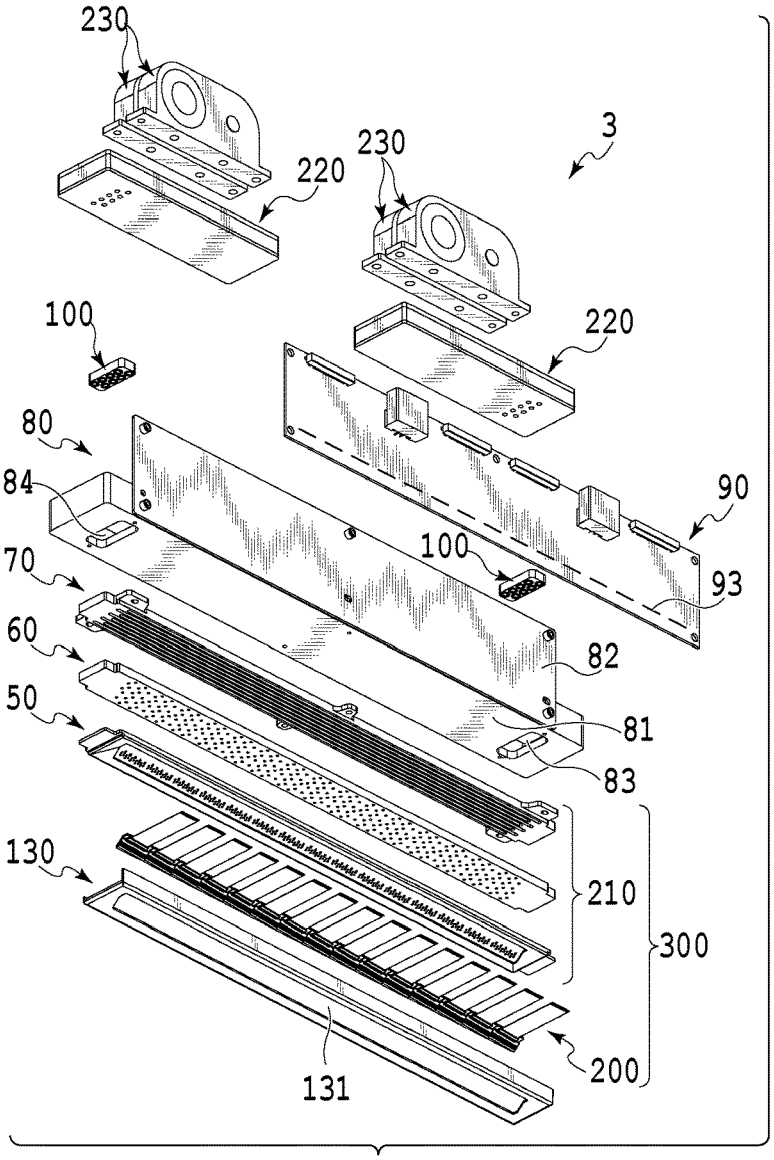
FIG. 24B is an exploded perspective view of the print head.

FIG. 24A is a perspective view of the print head 3 in the present embodiment, and FIG. 24B is an exploded perspective view of the print head 3. The print head 3 in the present example is a line ink jet print head having a length corresponding to the full width of the print medium. The print head 3 includes a plurality of printing element substrates 10 linearly disposed therein. Each of the printing element substrates 10 is supplied, via a flexible wiring board 40 and an electric wiring board 90, with a driving signal allowing the ink to be ejected from the printing apparatus and power needed to eject the ink. The driving signal is input to a signal input terminal 91, and the power is input to an electric supply terminal 92. A channel member 210 forming the ink channel is set lower in thermal diffusivity than the printing element substrate 10 to allow the heat in the printing element substrate 10 to be made less likely to be transferred to the ink in the ink channel. Consequently, regardless of the position of each of the printing element substrates 10, the temperature of each of the printing element substrates 10 can be made constant, allowing the ink ejection characteristics to be made uniform.

An ejection unit 300 includes an ejection module 200 including the printing element substrate 10, and the channel member 210. A cover member 130 provided with an opening 131 is attached to the ejection unit 300. A housing 80 includes a support component 81 that supports the ejection unit 300 and a support component 82 that supports the electric wiring board 90. The print head 3 in the present example includes a supply unit 220 and a negative-pressure control unit 230 described below. The supply unit 220 communicates with the ejection module 200 through a joint 100, openings 83, 84 in the support component 81, and the channel member 210. A connection terminal 93 of the electric wiring board 90 is electrically connected to the printing element substrate 10. In FIG. 24A and FIG. 24B, four negative-pressure control units 230 are provided which supply inks in four colors.

Figure 25:
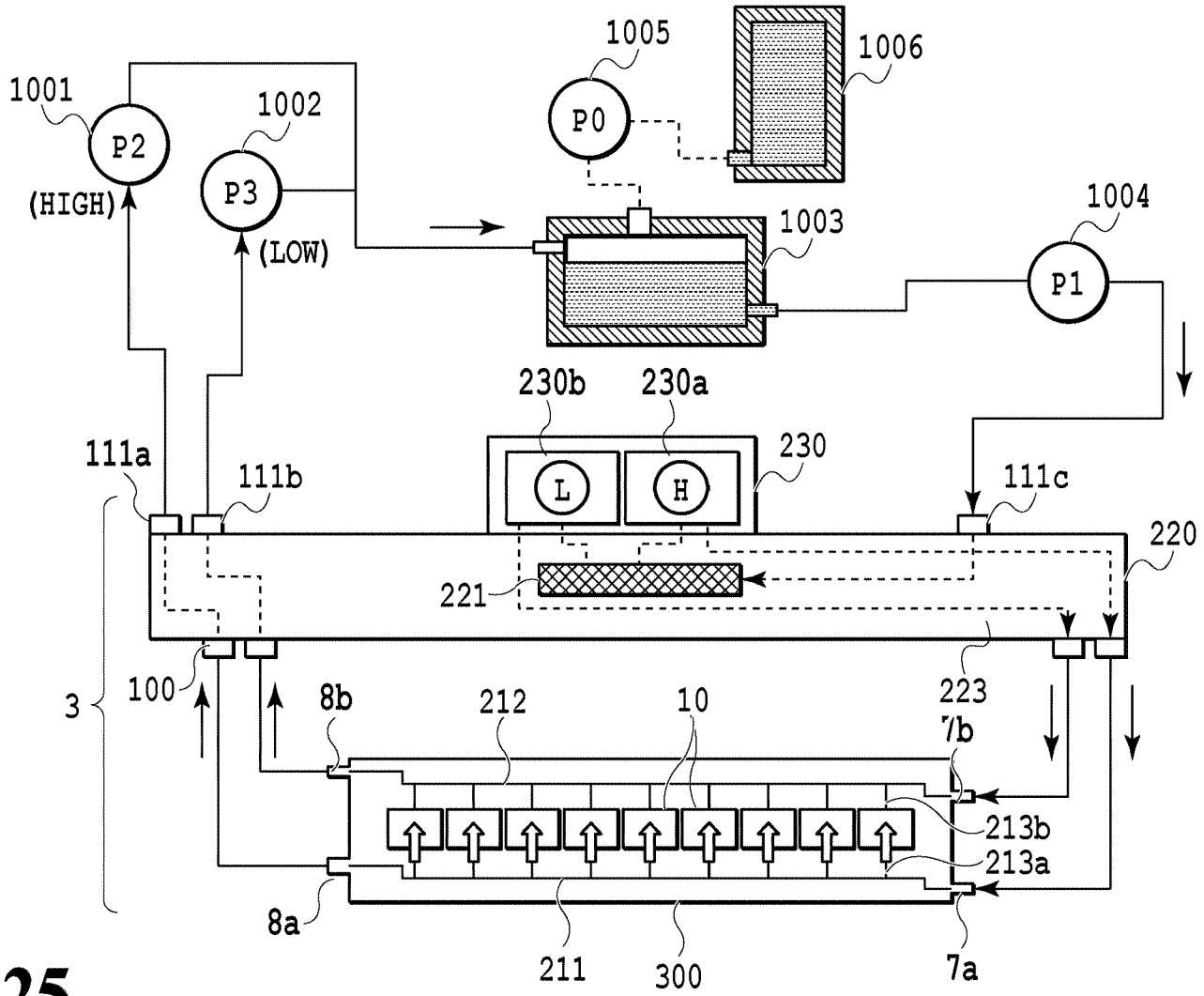
FIG. 25 is a diagram illustrating a supply system for ink in the print head in FIG. 24A.

FIG. 25 is a diagram illustrating an ink supply system in the present embodiment. A connection portion 111*a* of the print head 3 is connected to a buffer tank 1003 in a fluid manner through a first circulating pump (high pressure side) 1001. A connection portion 111*b* of the print head 3 is connected to the buffer tank 1003 in a fluid manner through a first circulating pump (lowpressure side) 1002. The buffer tank 1003 is refilled with the ink from a main tank 1006 by a refilling pump 1005. For simplification of description, FIG. 25 depicts only a circulating path for ink in one color. In actuality, circulating paths for inks in a plurality of colors such as four colors are formed. First circulating pumps 1001, 1002 suck the ink through the connection portions 111*a*, 111*b* of the print head and feed the ink to the buffer tank 1003. The first circulating pumps 1001, 1002 are preferably positive displacement pumps having quantitative fluid delivery capabilities. Specific examples of the first circulating pumps 1001, 1002 include tube pumps, gear pumps, diaphragm pumps, and syringe pumps. For example, the first circulating pumps 1001, 1002 may be configured such that, for example, a general constant-flow valve or relief valve is disposed at a pump outlet to provide a given flow rate.

The print head 3 is provided with the common supply path 211 and the common collection path 212, which are common to the plurality of printing element substrates 10. In the printing element substrate 10, one side of the pressure chamber communicates with the common supply path 211 via the branching supply path 213*a*. The other side of the pressure chamber communicates with the common collection path 212 via the branching collection path 213*b*. A first collection port 8*a* of the common supply path 211 communicates with the first circulating pump (high pressure side) 1001 via the supply unit 220. A second collection port 8*b* of the common collection path 212 communicates with the first circulating pump (low pressure side) 1002 via the supply unit 220. In a case where the print head 3 is driven to eject the ink through the ejection port 13, the first circulating pump (high pressure side) 1001 and the first circulating pump (low pressure side) 1002 allow a given amount of ink to flow through the common supply path 211 and the common collection path 212.

The negative-pressure control unit 230 is disposed in a path between a second circulating pump 1004 and the ejection unit 300, and includes a high-pressure-side pressure adjustment mechanism 230*a* and a low-pressure-side pressure adjustment mechanism 230*b*. The pressure adjustment mechanisms 230*a* and 230*b* adjust the ink fed from the second circulating pump 1004 to a high pressure or a low pressure. The ink adjusted to the high pressure by the pressure adjustment mechanism 230*a* is fed to the common supply path 211 through a first inlet port 7*a*. The ink adjusted to the low pressure by the pressure adjustment mechanism 230*b* is fed to the common collection path 212 through a second inlet port 7*b*. Therefore, the static pressure inside the common supply path 211 is higher than the static pressure inside the common collection path 212. The negative-pressure control unit 230 has a function to keep the differential pressure between the high-pressure ink at the first inlet port 7*a* and the low-pressure ink at the second inlet port 7*b* constant even in a case where the circulating flow rate of the ink in the print head 3 fluctuates according to a print duty. The pressure adjustment mechanisms 230*a* and 230*b* may have any configuration so long as the configuration allows a constant differential pressure to be maintained. The pressure adjustment mechanisms 230*a* and 230*b* may be configured similarly to what is called a "pressure reducing regulator".

The second circulating pump 1004 may be any pump so long as the pump allows a given lifting height pressure or higher to be applied within the ink circulating flow rate while the print head 3 is being driven. Specifically, a diaphragm pump or the like is applicable. Instead of the second circulating pump 1004, a tank may be applied which is arranged to have a given head difference with respect to the negative-pressure control unit 230.

As described above, the pressure adjustment mechanisms 230*a* and 230*b* in the negative-pressure control unit 230 apply a given differential pressure to the ink fed to the common supply path 211 and the common collection path 212. Thus, in all of the pressure chambers in the printing element substrate 10, the ink flows from the common supply path 211 toward the common collection path 212 as depicted by arrows in FIG. 25.

As described above, in the configuration in which the ink is circulated through the plurality of printing element substrates 10 disposed in series, the temperature of the ink flowing into the printing element substrate 10 varies depending on the position where the printing element substrate 10 is disposed. In this case, the printing element substrate 10 into which relatively hot ink flows is likely to have the temperature of the substrate elevated. On the other hand, the printing element substrate 10 into which relatively cold ink flows is likely to have a large time constant at which the temperature of the ink is elevated to the target value. Thus, the magnitude of variation in the temperature of the ink in the pressure chamber increases according to the position in the printing element substrate 10, leading to variation in ink density. As a result, an image defect may occur in which the varied ink density is viewed as density unevenness in printed images.

Thus, in the present embodiment, the heating value of the heating element is corrected for each of the printing element substrates 10 in accordance with the heat transfer characteristics of the printing element substrate 10. Consequently, regardless of the disposition position of the printing element substrate 10, the temperature of the ink in the pressure chamber can be controllably made uniform.

Figure 26:
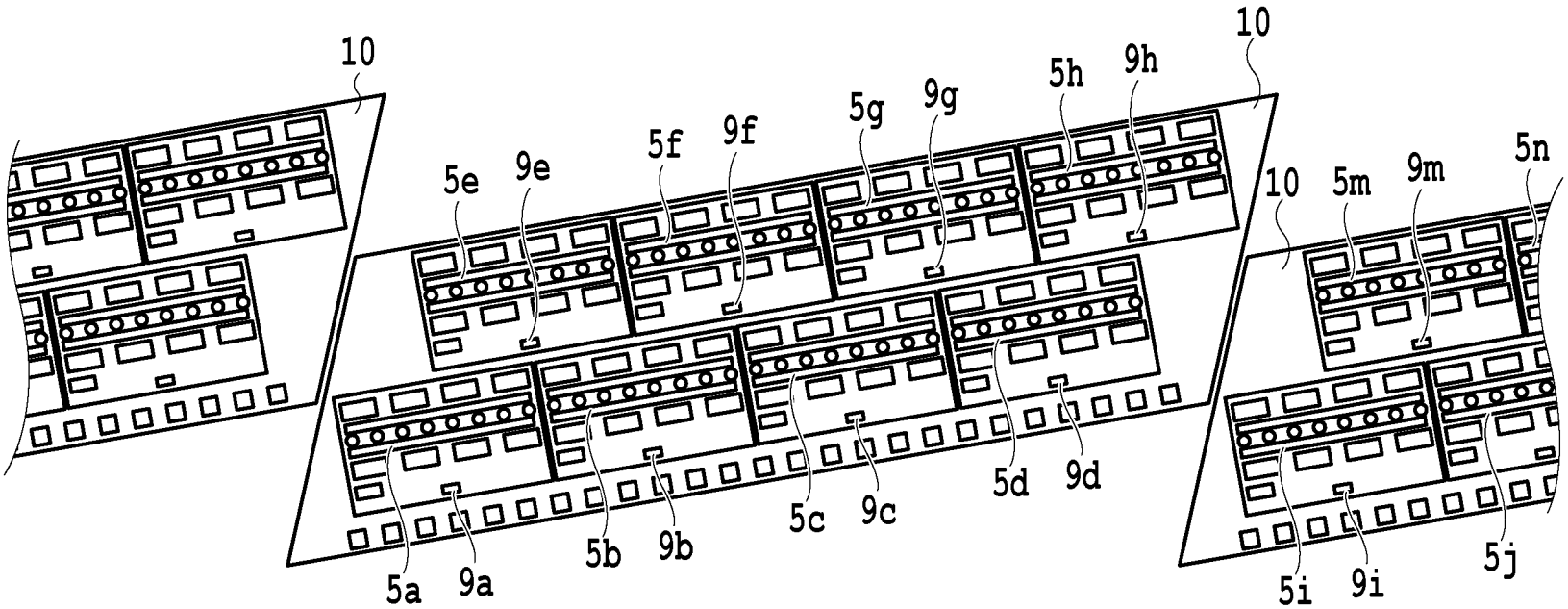
FIG. 26 is a diagram illustrating an example of a layout of heating elements and temperature detection elements in the print head in FIG. 24A.

FIG. 26 is a diagram illustrating an example of layout of the heating elements 5 and the temperature detection elements 9 in the print head 3 in the present embodiment.

Each of the printing element substrates 10 includes a plurality of the temperature detection elements 9 (9*a*, 9*b*, 9*c*, . . . ) and the heating elements 5 (5*a*, 5*b*, 5*c*, . . . ) corresponding to the temperature detection elements 9. All the printing element substrates 10 mounted in the print head 3 are similarly configured. In the present example, for each of the heating areas corresponding to the respective heating elements 5, the heat transfer characteristics associated with the configuration of the ink supply path are taken into account, and the heating value of each heating element 5 is corrected in accordance with the heat transfer characteristics. Thus, heating value tables as illustrated at portions (a), (b), (c), (d) in FIG. 27 are stored in a register mounted in the printing apparatus main body or the print head 3 so that the heating elements 5 are controllably driven based on the heating value tables.

For example, in a case where the target temperature is 40° C., the detected temperature from the temperature detection element 9*i* is 28° C., the temperature difference (ΔT) is 12° C. Based on the default reference target ID "20" corresponding to the temperature difference, the correction amount "−1" for the heating value is added to the reference target ID "20" to correct the reference target ID to "19". With reference to the heating value table in FIG. 3 described above, the heating element 5*i* is driven so as to set the heating value of the heating element 5*i* to 11.9 W, which corresponds to the reference target ID "19".

As described above, discretely controlling the heating value of each heating element enables not only minimization of the bias of the temperature distribution in the printing element substrate 10 but also a reduction in the bias of the temperature distribution in all of the printing element substrates 10 in the print head 3. Thus, for example, in a line ink jet print head configured to print an image on the print medium through one pass, the ink ejection characteristics of the whole print head can be made uniform to enable high-quality images to be printed at high speed.

In the present embodiment, the heating value of the heating element is corrected by varying the reference target for each of the heating elements in each printing element substrate 10 using one heating value table as illustrated in FIG. 27. As described above, the correction can be achieved simply by providing one reference table (heating value table), enabling a substantial reduction in circuit scale. For example, in a case where the circuit scale is allowed to be increased to some degree, a heating value table may be provided for each printing element substrate. The heating value may be controlled so as to correct the electrical characteristics of the heating element or to collectively correct the electrical characteristics of the heating elements in all of the printing element substrates mounted in the print head 3.

Other Embodiments

The present invention is not limited to the ink jet print head, the ink jet printing apparatus, and the temperature control method for the ink jet print head but is widely applicable to liquid ejection heads and liquid ejection apparatuses configured to eject various liquids and temperature control methods for liquid ejection heads. The present invention is applicable to various types of printing apparatuses such as the above-described full line type and a serial scan type.

Besides an ink jet printing apparatus that prints an image using an ink jet print head that can eject ink, the present invention is widely applicable to liquid ejection apparatuses using liquid ejection heads that can eject various liquids. The present invention is applicable to, for example, apparatuses such as a printer, a copier, a facsimile machine having a communication system, and a word processor with a printer unit, and industrial processing apparatuses combined with various processing apparatuses. The present invention can be used for applications such as biochip production and electronic-circuit printing. The liquid ejection apparatus includes moving means for moving a liquid ejection head relative to a medium to which a liquid ejected from the liquid ejection head is applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-061802 filed Mar. 25, 2016, which is hereby incorporated by reference herein in its entirety.

What is claimed is:

1. A liquid ejection head that ejects a liquid through ejection ports, the liquid ejection head comprising:

ejection energy generation elements configured to generate energy utilized to eject the liquid;

a detection unit configured to detect a temperature of the liquid ejection head;

a heating unit configured to heat the liquid ejection head by a heating value varying according to a temperature difference between a temperature detected by the detection unit and a predetermined target temperature;

a plurality of pressure chambers each configured to communicate with a corresponding one of a plurality of the ejection ports and containing one of the ejection energy generation elements;

a common liquid supply path configured to communicate with one side of each of the plurality of pressure chambers; and a common liquid collection path configured to communicate with the other side of each of the plurality of pressure chambers, wherein the common supply path has a higher internal static pressure than the common collection path.

2. The liquid ejection head according to claim 1, wherein the detection unit includes a first detection unit configured to detect a temperature in a first area and a second detection unit configured to detect a temperature in a second area, the heating unit includes a first heating unit configured to heat the first area and a second heating unit configured to heat the second area, and the liquid ejection head includes a driving unit configured to allow the first heating unit to generate heat according to a temperature difference between the predetermined target temperature and a temperature detected by the first detection unit and to allow the second heating unit to generate heat according to a temperature difference between the predetermined target temperature and a temperature detected by the second detection unit.

3. The liquid ejection head according to claim 2, wherein the first area is higher in temperature diffusivity than the second area, and the driving unit sets a heating value of the first heating unit larger than a heating value of the second heating unit.

4. The liquid ejection head according to claim 2, wherein the first area is positioned on an upstream side in the common supply path with respect to the second area, and the driving unit sets the heating value of the first heating unit larger than the heating value of the second heating unit.

5. The liquid ejection head according to claim 4, wherein the common supply path supplies the liquid to the plurality of pressure chambers through supply ports, and the first area is positioned closer to the supply ports than the second area.

6. The liquid ejection head according to claim 2, wherein in a case where one of the first heating unit and the second heating unit has a larger heating value than the other, the driving unit reduces a driving pulse so as to make heat generation energy of the first heating unit and heat generation energy of the second heating unit equal.

7. The liquid ejection head according to claim 2, wherein at least one of the first heating unit and the second heating unit comprises a plurality of heating units.

8. The liquid ejection head according to claim 2, wherein at least one of the first detection unit and the second detection unit comprises a plurality of detection units.

9. The liquid ejection head according to claim 2, wherein the driving unit varies at least one of a magnitude of a driving voltage and a length of a driving pulse for the first heating unit and the second heating unit to vary the heating values of the first heating unit and the second heating unit.

10. The liquid ejection head according to claim 2, wherein the driving unit includes a first driving unit disposed in the first area and configured to allow the first heating unit to generate heat and a second driving unit disposed in the second area and configured to allow the second heating unit to generate heat.

11. The liquid ejection head according to claim 1, wherein the liquid in each of the pressure chambers is circulated to and from outside of the pressure chamber.

12. A liquid ejection apparatus comprising:

a liquid ejection head configured to eject a liquid through ejection ports; and a moving unit configured to move the liquid ejection head relative to a medium to which the liquid ejected from the liquid ejection head is applied, wherein the liquid ejection head comprises:

ejection energy generation elements configured to generate energy utilized to eject the liquid;

a detection unit configured to detect a temperature of the liquid ejection head;

a heating unit configured to heat the liquid ejection head by a heating value varying according to a temperature difference between a temperature detected by the detection unit and a predetermined target temperature;

a plurality of pressure chambers each configured to communicate with a corresponding one of a plurality of the ejection ports and containing one of the ejection energy generation elements;

a common liquid supply path configured to communicate with one side of each of the plurality of pressure chambers; and a common liquid collection path configured to communicate with the other side of each of the plurality of pressure chambers, wherein the common supply path has a higher internal static pressure than the common collection path.

13. A temperature control method for a liquid ejection head enabled to eject a liquid through a plurality of ejection ports, the liquid ejection head including the ejection ports, a plurality of pressure chambers each configured to communicate with a corresponding one of the plurality of ejection ports and containing an ejection energy generation element, a common liquid supply path configured to communicate with one side of each of the plurality of pressure chambers, and a common liquid collection path configured to communicate with the other side of each of the plurality of pressure chambers, wherein the common supply path has a higher internal static pressure than the common collection path, the method comprising:

a first detection step of detecting a temperature in a first area in which some of the plurality of ejection ports are disposed;

a second detection step of detecting a temperature in a second area in which some of the plurality of ejection ports are disposed; and a heating step of heating the first area according to a temperature difference between a predetermined target temperature and the temperature detected in the first detection step and heating the second area according to a temperature difference between the predetermined target temperature and the temperature detected in the second detection step.

14. A liquid ejection head that ejects a liquid through ejection ports, the liquid ejection head comprising:

ejection energy generation elements configured to generate energy utilized to eject the liquid;

a detection unit configured to detect a temperature of the liquid ejection head, the detection unit including a first detection unit configured to detect a temperature in a first area and a second detection unit configured to detect a temperature in a second area;

a heating unit configured to heat the liquid ejection head, the heating unit including a first heating unit configured to heat the first area and a second heating unit configured to heat the second area;

a driving unit configured to allow the heating unit to generate heat by a heating value varying according to a temperature difference between a temperature detected by the detection unit and a predetermined target temperature; and a supply path through which the liquid is fed to a plurality of the ejection ports, wherein the driving unit allows the first heating unit to generate heat according to a temperature difference between the predetermined target temperature and a temperature detected by the first detection unit and allows the second heating unit to generate heat according to a temperature difference between the predetermined target temperature and a temperature detected by the second detection unit, the first area is positioned on an upstream side in the supply path with respect to the second area, and the driving unit sets the heating value of the first heating unit larger than the heating value of the second heating unit.

15. The liquid ejection head according to claim 14, further comprising a plurality of pressure chambers each configured to communicate with a corresponding one of the plurality of the ejection ports and containing one of the ejection energy generation elements;

a common liquid supply path configured to communicate with one side of each of the plurality of pressure chambers; and a common liquid collection path configured to communicate with the other side of each of the plurality of pressure chambers, wherein the common supply path has a higher internal static pressure than the common collection path.

16. The liquid ejection head according to claim 15, wherein the liquid in each of the pressure chambers is circulated to and from outside of the pressure chamber.

* * * * *